US009013314B2

(12) United States Patent
Golomb et al.

(10) Patent No.: US 9,013,314 B2
(45) Date of Patent: Apr. 21, 2015

(54) SYSTEM FOR INDICATING INSTRUCTIONS INCLUDING MONITORING OF SIGNAL STRENGTH OR DISTANCE

(76) Inventors: Jordan Rivard Golomb, Maple Grove, MN (US); Christopher J. Golomb, Maple Grove, MN (US); Terry Rivard, Minneapolis, MN (US); Scott Rivard, Minneapolis, MN (US)

( * ) Notice: Subject to any disclaimer, the term of this patent is extended or adjusted under 35 U.S.C. 154(b) by 222 days.

(21) Appl. No.: 13/607,369

(22) Filed: Sep. 7, 2012

(65) Prior Publication Data

US 2013/0063268 A1 Mar. 14, 2013

Related U.S. Application Data

(60) Provisional application No. 61/532,473, filed on Sep. 8, 2011.

(51) Int. Cl.
*G08B 21/00* (2006.01)
*G08B 21/02* (2006.01)

(52) U.S. Cl.
CPC ..... *G08B 21/0294* (2013.01); *G08B 21/0205* (2013.01)

(58) Field of Classification Search
CPC ..... G08B 21/025; G08B 21/0288; G08B 21/0266
USPC ..... 340/539.14, 573.1, 573.4, 568.1, 340/539.13, 539.15; 455/456.1–457
See application file for complete search history.

(56) References Cited

U.S. PATENT DOCUMENTS

| | | | | |
|---|---|---|---|---|
| 5,652,569 | A | 7/1997 | Gertenberger et al. | 340/573 |
| 6,313,733 | B1 | 11/2001 | Kyte | 340/7.22 |
| 7,043,224 | B1 | 5/2006 | Baxter | 455/401 |
| 8,068,022 | B2 * | 11/2011 | Ben-Itzhak et al. | 340/539.13 |
| 2003/0218539 | A1 * | 11/2003 | Hight | 340/539.13 |

* cited by examiner

*Primary Examiner* — Jeffery Hofsass
(74) *Attorney, Agent, or Firm* — Jordan Rivard Golomb

(57) ABSTRACT

An indicating system and method having a parent unit communicable with a child unit is provided. In an embodiment for the indicating system and method of the present invention, the child unit may be responsive to receiving a signal from the parent unit for communicating instructions (e.g., traffic signal based, protective based etc.) which may result in a visual, and/or audio and/or tactile indication being provided to the user of the child unit. In an embodiment of the present invention, the system may communicate instructions, praise or other information, educational or otherwise to a child unit via actuators on the parent unit or by an auto mode feature utilizing signal strength detection/proximity sensing technology. Safety enhancing features, entertainment and encouragement features may be incorporated into the system.

19 Claims, 17 Drawing Sheets

SYSTEM FOR INDICATING INSTRUCTIONS INCLUDING MONITORING OF SIGNAL STRENGTH OR DISTANCE

The present application claims priority to Provisional Patent Application Ser. No. 61/532,473 filed on Sep. 8, 2011 and is herein incorporated by reference.

BACKGROUND

1. Field of the Invention

The present invention relates generally to an indicating system. One embodiment of the system is communicating directions to a child, and more particularly to communicating directions to a child riding a bike or other apparatus. Directions such as: to stop at a street crossing or when the child has gotten too far ahead and/or to communicate or teach certain "rules of the road" like staying to the right side of a bike path unless passing someone, or teaching them to alert people that they are passing them, to put on their helmet, or to put their bike away and so forth. Transmissions from a parent unit can also be used to praise the child for positive actions using either pre-recorded messages or a transmission of the signal representing an audible sound transmitted from the parent unit, features on a display or tactile output to gain the attention of the child or other user. Other embodiments include but are not limited to use with mentally impaired or differentiated individuals, someone with an impaired sense such as hearing or seeing, or others requiring or wanting instructions or direction from another, or simply two or more people engaged in a variety of activities.

2. Discussion of the Related Art

No system or method for communicating directions to a young child riding a bike or other apparatus are known other than the traditional method of yelling or shouting to a child that has strayed too far ahead of their parents, or is not following the rules of the road such as riding on the wrong side of the path or sidewalk. Additionally, certain individuals, particularly younger children and the mentally challenged get their right and their left directions mixed up. Also, children feel nagged when given instructions to wear a helmet or put their bike away. Adults trying to keep children safe by repeatedly nagging them to put on their helmet or yelling ahead to their child often find themselves frustrated and aggravated when the only way they can communicate to their child is to yell or shout at them which is hard to do without sounding angry and to ask them to do the same things over and over again. Children at even a short distance away from their parents, or in an environment with a certain level of ambient noise may feel anxiety and anger when being shouted at and do not understand that the lack of an improved method of communicating with them makes it necessary for their parent, guardian or second user to do so.

SUMMARY OF THE INVENTION

An audio and/or visual and/or tactile indication system with a parent unit communicable with a child unit having indicators (e.g., audio and/or visual and/or tactile) is provided. Herein the terms parent unit and child unit will be used for convenience and clarity, but any manner of naming could be used such as a command unit and a receiving unit, or an A unit and a B unit. In an embodiment for the indicating system of the present invention, the child unit is responsive to receiving a signal representative of a command, or a signal representative of an audible sound transmitted from the parent unit, that the parent wants to communicate to the child, generally for the child's safety, education or for offering praise.

In an embodiment of the present invention, an indicating system for providing instructions remotely (e.g., wireless) is provided. The indicating system may comprise a parent unit comprising a parent unit housing, a parent unit power source (e.g., for example, a battery or rechargeable battery) associated with the parent unit housing, a parent communication unit (e.g., for example, a transmitter and/or receiver) operably connected to the parent unit power source, and an out of range indicator (e.g., for example, an indicator to inform the user about the proximity between the parent unit and the child unit, the signal strength between unit, signal loss between the units, or distance between the units). The indicating system may further comprise a remotely located child unit comprising, a child unit housing (e.g., one or more housings, wherein the housing may be mountable to or coupled to a person, a bicycle or any other mobile apparatus including an ATV, snowmobile, battery operated vehicle, etc.), a child unit power source (e.g., for example, a battery or rechargeable battery) associated with the child unit housing, a child communication unit (e.g., for example, receiver and/or transmitter) operably connected to the child unit power source, the child communication unit operable to receive one or more signals from the parent communication unit, and an output indicating device (e.g., for example, visual, audio, and or tactile indicators), wherein when a strength of the signal between the parent unit and the child unit drops below a predetermined level, the out of range indicator may be activated on the parent unit, and a protective instruction (e.g., for example, a first protective instruction, by way of an indication stop, wait, halt, use caution, slow down, pull over, come back, turn around or any other suitable message) is generated by the output indicating device of the child unit.

In one embodiment, when the strength of the signal between the parent unit and the child unit drops below or above a second or third predetermined level or threshold, or lies in a specified range, a second or third protective instruction, respectively, is generated by the output indicating device of the child unit. Further, the second or third protective instructions may be a cautionary message configured to communicate a warning to the user of the child unit (e.g., for example a warning to slow down, prepare to stop, inform the child that they are getting too far away, you need to stop soon or any other suitable message or may be related to the first protective instruction as previously described) is generated by the output indicating device of the child unit. Further, when the strength of the signal between the parent unit and the child unit drops below the second or third predetermined level, a second or third out of range signal may be generated on the parent unit, respectively (e.g., three separate out of range indicators on the parent unit, or one indicator that changes in color (e.g., red, orange, yellow, green, or changes in sound or vibration level aggressiveness/severity/harshness).

In one embodiment, the child unit may produce a response upon receiving a signal representative of an audible sound transmitted from the parent unit (e.g., for example, a voice message communicated from a microphone on the parent unit played via a speaker of the child unit). Further, the child unit may produce a response upon receiving one or more signals from the parent unit, further wherein the child unit may configured to produce a response including one or more pre-recorded messages corresponding to the signals (e.g., for example, information, educational or instructional messages).

In one or more embodiments, the parent communication unit may transmit signals communicating one or more instructions, including but not limited to, traffic signal based instructions (e.g., for example, the traffic signal based instructions may indicate the direction and/or movement, relative to the user, that the guardian wants the user of the remotely located child unit to undertake, including, but not limited to: stop, caution, go, turn or move right, turn or move left, make a u-turn). Further, the output indicating device may include one or more instructional indicators configured to communicate the one or more traffic signal based instructions.

In one embodiment, the child unit includes a power switch (e.g., any suitable switch) and a speaker, wherein the power switch is configured to play a pre-recorded message (e.g., for example, "Are you ready to go?". "Do you have your helmet on?" and/or "If you have your helmet on, press the helmet on button", "If you have your helmet on, do a funky dance", or any other suitable message) via the speaker when switched into the on position. In one or more embodiments, actuation of one or more actuators on either the parent and/or the child unit may provide one or more celebratory responses (e.g., for example, blinking, noise, music, other sounds, vibration etc. of the child or parent unit).

In an embodiment of the present invention, the parent unit may comprise one or more actuators configured to transmit one or more signals upon actuation of the one or more actuators. The one or more child units may be configured to receive the one or more signals, further wherein the child unit is configured to communicate one or more traffic signal based instructions based on the one or more signals received from the parent unit (e.g., stop, go, caution, slow down, turn or move right, turn or move left, turn around, make a u-turn, or any suitable information.)

In an embodiment for a method of the present invention, a method for providing an audio and/or visual and/or tactile indication system is provided. The basic method includes the steps of transmitting a signal from a parent unit to a child unit to communicate an instruction, command, message or feedback that the user of the parent unit wants to communicate to the child unit, or of a signal representative of an audible sound transmitted from the parent unit, that the parent wants to communicate to the child unit, generally for the user of the child unit's safety or to praise the child, and wherein the signal received from the parent unit may be provided as an indication on the child unit.

The description herein provides mere embodiments of the present indicating system invention but should not be construed as limiting its scope. It should be noted that other variations and combinations of features are also possible and considered without departing from the overall intent of the present invention. For example, variations in the shape of the housings, recesses in the housing to mate up with handlebars or other mating surface, whether there is one housing or the features of the invention are incorporated into the design of a mobile apparatus, the method of coupling the child and parent units to a bicycle or any other mobile apparatus, or to the users, either directly or indirectly, and the type, shape, color, sound or feel of the indicators, the content of the messages to be conveyed, the locations may be re-arranged as desired or suitable to provided the desired configuration, or the inclusion of supplementary features and accessories customary to mobile apparatuses or to mobile/wireless devices, and signal transmission methods, and activities the device could be used in other than those shown and described herein may be incorporated into the present invention.

BRIEF DESCRIPTION OF THE DRAWINGS

The various features of the invention will be best appreciated by simultaneous reference to the description which follows and the accompanying drawings.

DETAILED DESCRIPTION

Figure 1A:
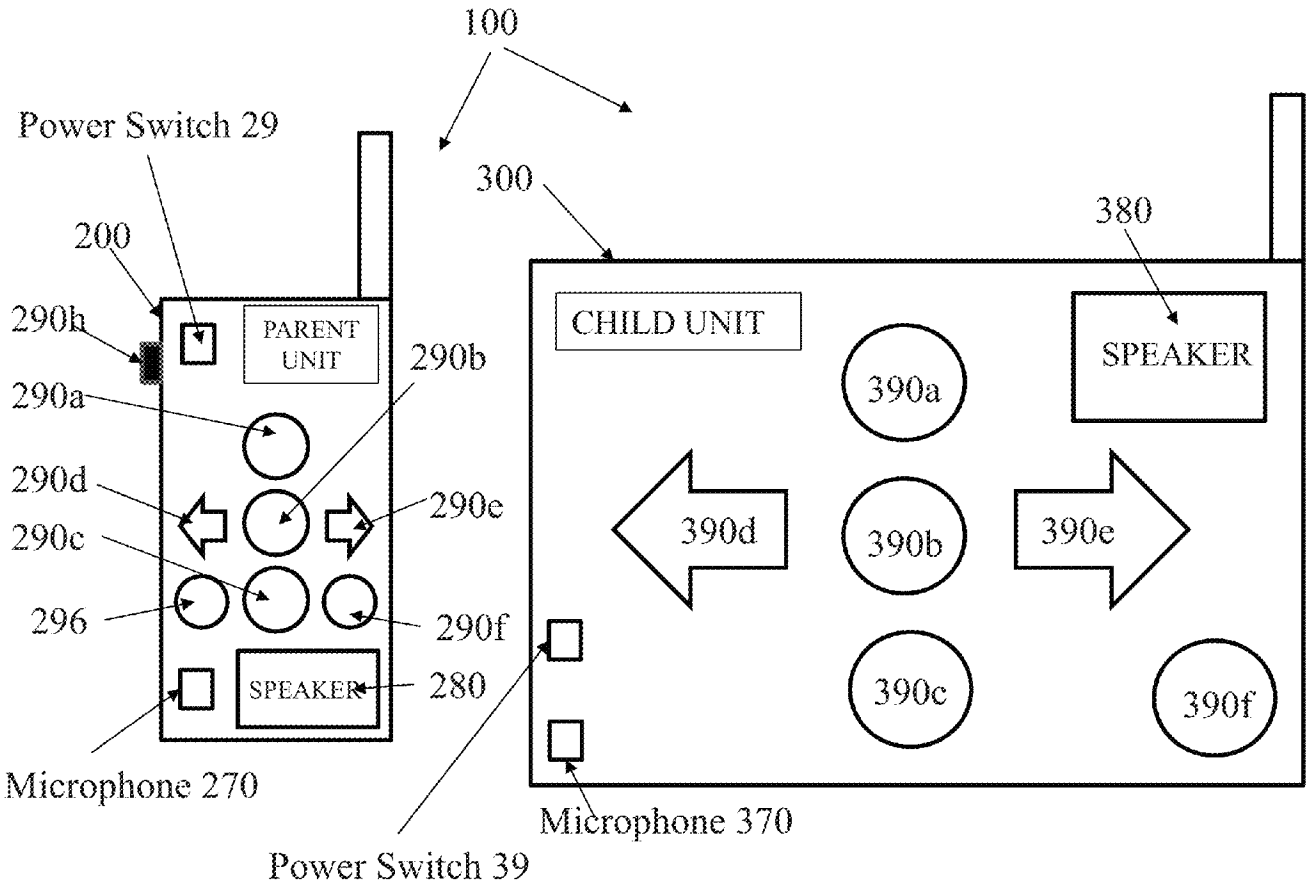
FIG. 1*a* and 1*b* are general illustrations of an indicating system in accordance with the principles of the present invention.
Figure 1B:
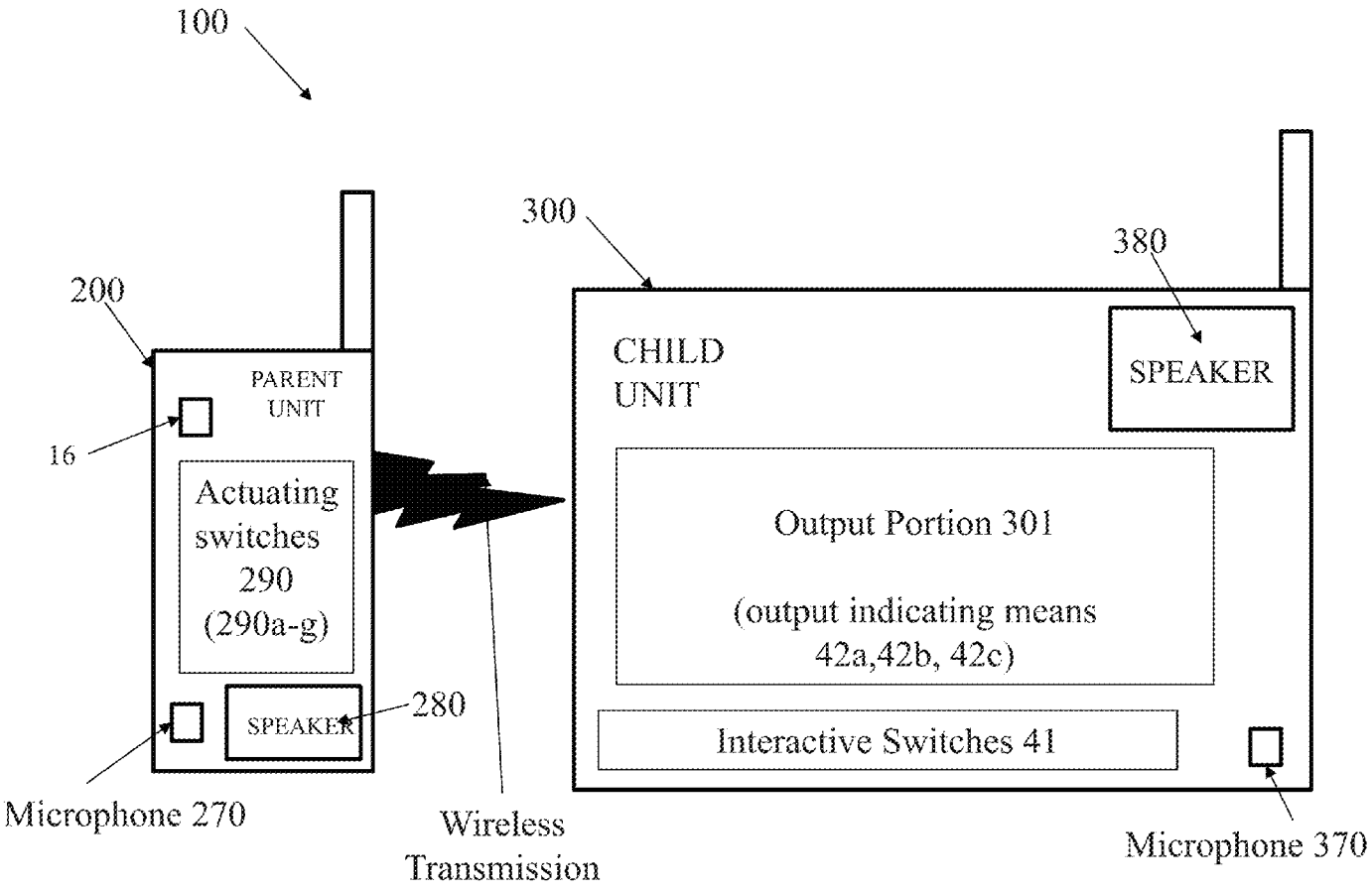

FIGS. 1*a* and 1*b* are general illustrations of an indicating system 100 in accordance with the principles of the present invention. The assembly 100 includes a parent unit 200 and a child unit 300. The parent unit 200 may be used remotely by a user to communicate directions to another user via the child unit 300. One particular embodiment may be for a parent or other responsible individual to communicate directions to a young child. Other embodiments exist, such as to communicate with any person on any type of mobile apparatus, tricycle, big wheel, wheel chair, scooter, pogo stick, unicycle, rock climbing, motorcycling, walking, water skiing/boating etc, driving etc.

As such, the child unit 300 may be responsive to receiving a signal representative of an instruction, command or feedback transmitted from the parent unit 200. The parent unit 200 may include various actuators 290*a-g* or other activation means, that when activated, transmit a signal command, or transmit a signal representative of an audible sound transmitted from the parent unit 200, to the child unit 300. The child unit 300 may be responsive to receiving a signal to activate a command comprising a visual and/or audio and/or tactile indication, and/or receive and signal representative of an audible sound transmitted from the parent unit 200, one or more pre-determined responses or pre-recorded messages, or any combination of these.

As shown in FIGS. 1*a*-1*b*, the parent unit 200 may include power switch 29 and may include other actuation switches

290*a-g*, which when activated, transmit visual/audio or tactile commands and the like to the child including, but not limited to, traffic signal based instructions, which may include for example: "stop" 290*a*, "slow down/caution/yield" 290*b*, "go"290*c*, "move to the left" 290*d*, "move to the right" 290*e*, "good job" 290*f*, "come back/make a U-turn" 290*g*. Other contemplated actuators include transmitting information to the child that parents commonly give children such as "10 more minutes of play", "5 more minutes of play", "playing time is up" etc. The parent unit 200 may include a voice command switch 290*h* and an associated microphone 270 for transmitting audio commands spoken by the parent to the child unit 300, alone, or in conjunction with an associated audio and/or visual and/or tactile indicators on the child unit 300.

As mentioned above, the child unit 300 may be responsive to receiving a control signal representative of a particular command or the like transmitted from the parent unit 200 when any of actuation switches 290*a-g* are activated. As such, the child unit 300 may include a speaker(s) 380. The child unit may communicate the desired instruction, message or command to the user (e.g., child or other individual) of the child unit, either via a pre-recorded message, or any of the actuation switches 290*a-g*, or 290*h* may enable the child unit 300 to receive a signal representative of an audible sound transmitted from the parent unit 200. This allows the parent to provide a more specific command captured by microphone 270 to be transmitted and played through speaker 380 on child unit 300. Further, the units may be enabled to switch between these two modes of operation as desired by the user or function in both modes simultaneously (e.g., using a mode switch). Visual and/or audio and/or tactile indication may be provided by output indicators 390*a-g*. When one of the actuation switches 290*a-g* on the parent unit 200 is activated, a signal is transmitted to the corresponding output device 390*a-g* on the child unit 300.

In the case where the output 42 plays pre-recorded messages or visual or tactile indications, these messages and visual indications, such as video, may be pre-recorded for the users (factory installed), recordable before use by the user, partially recorded by the user, for example the user could record the child's name to be used in the prerecorded messages, or could be updated by downloading new pre-recorded messages from the internet or media storage device via a USB port or other access point which may or may not include the child's name in the messages. Updating the pre-recorded messages may keep the device fresh and interesting to the child or other user receiving messages on the device. For example, as the user of the child unit matures, they may be interested in different licensed characters or celebrities and the pre-recorded messages could be changed to a different voice and style, with different background sounds or music. Additionally, the child may be more receptive to Grandpa's voice than the parents, so pre-recording messages using Grandpa's voice before using the device could improve compliance by the child to the instructions.

Figure 2A:
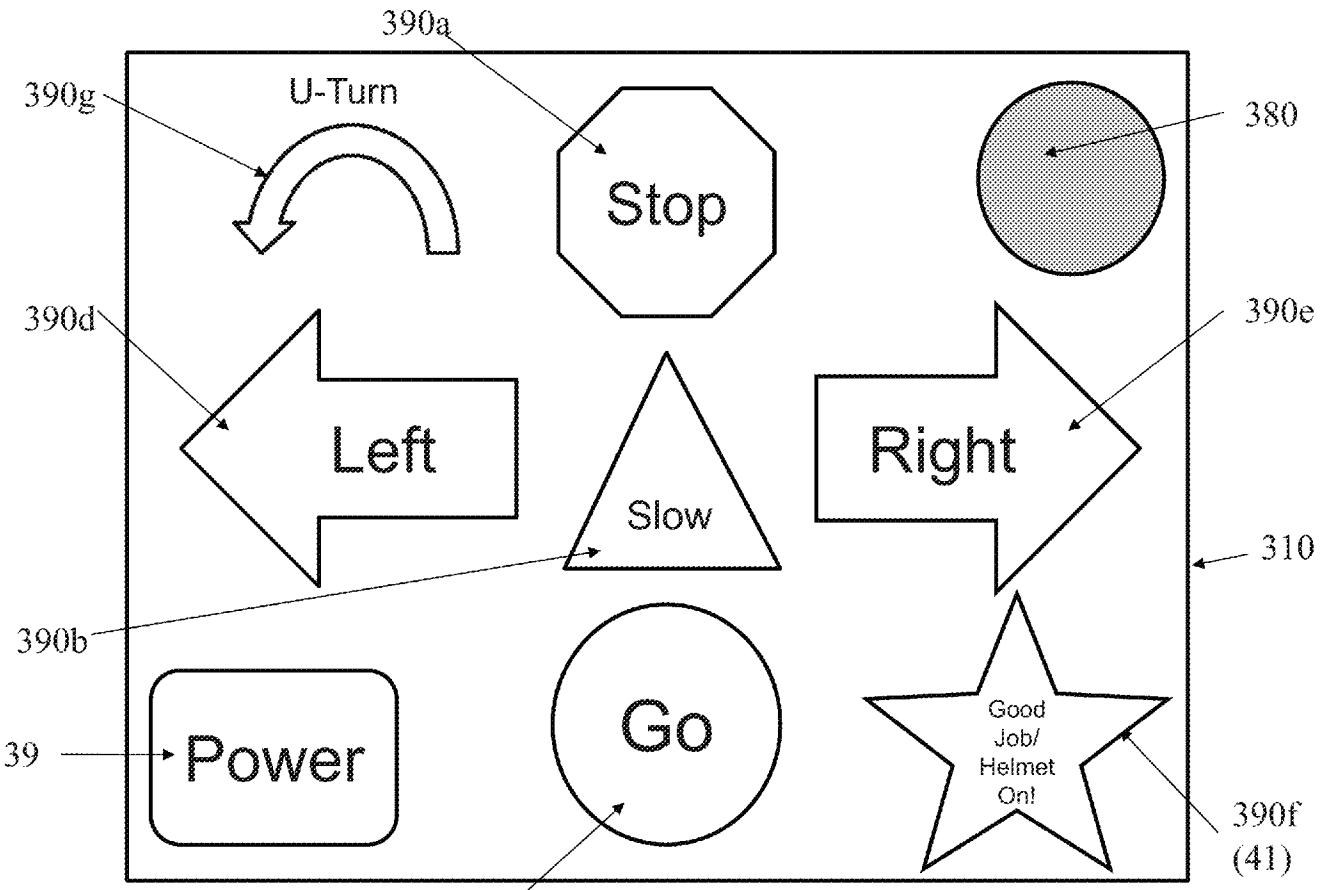
FIG. 2*a* is a plan view of a first physical embodiment of the child unit of an indicating system according to the present invention.
Figure 2B:
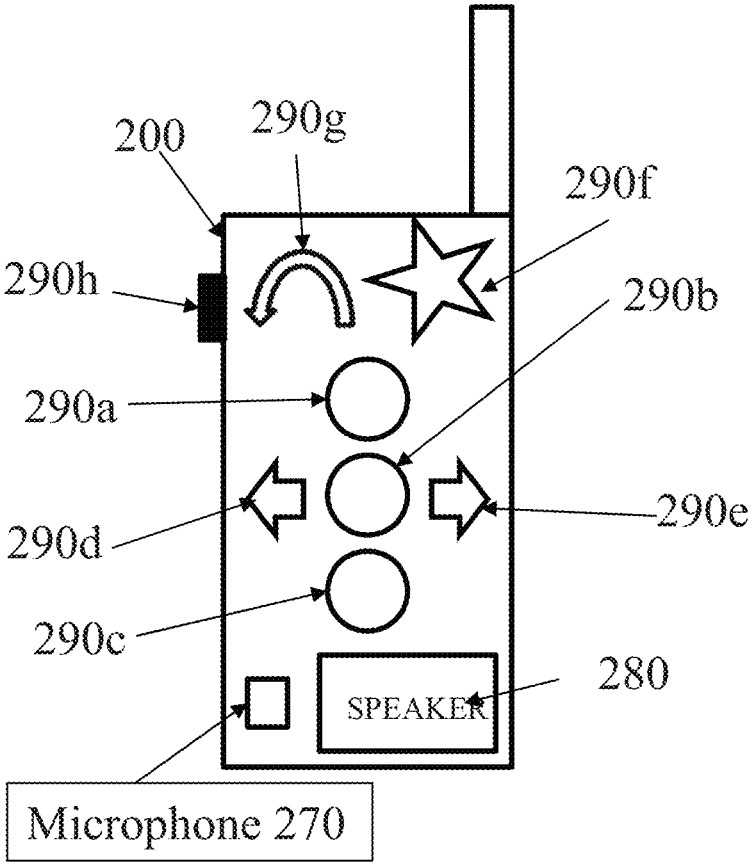
FIG. 2*b* is a plan view of a first physical embodiment of the parent unit of an indicating system according to the present invention.

As shown in FIG. 2*a*, visual indicating portion 390*a-g* can include, but aren't limited to, light-emitting diodes (LED's), lamps, fiber optics or an LCD screen(s). The child unit 300 may have output indicating device 42, which may include visual indicators (390*a-g*) which correspond to each actuator (290*a-g*) or other suitable actuating device on the parent unit 200 as shown in FIG. 2*b*, providing messages or traffic signal based instructions (stop, go, caution, move or turn left, move or turn right, make a u-turn, etc.), with or without complimentary audible or tactile indicators on the child unit 300 such as, but not limited to: "stop" 390*a*, "slow down/caution/yield" 390*b*, "go" 390*c*, "move to the left" 390*d*, "move to the right" 390*e*, "good job" 390*f*, "come back/make a U-turn" 390*g*. The output may be extended beyond a command, for example, indicating portion 390*a* could be educational as well (and as part of a mode switch could address different levels of educational needs by offering different levels of educational modes to select from), the indicator may be in the shape of a stop sign, the device may instruct the child to "pedal backwards or apply the handbrake" or the message may say "a stop sign is red", "the shape of a stop sign is called an octagon, an octagon has 8 sides". Further, the child unit may have an operating mode (e.g., for example, a mode in which the child unit 300 is enabled to transmit directions from the parent unit 200 to the child unit 300) and an educational mode (e.g., for example, a mode in which the device is used to educate the user. The educational matter may include, but is not limited to, shapes colors, rules of the road, safety information or entertainment matter). Further, in the educational mode, the child unit 300 may or may not be receiving transmissions from the parent unit 200, or further could be activated by buttons or other switches located on child unit 300. A mode switch located on either or both of the child unit 300 and parent unit 200 may allow switching between the modes including an additional auto mode to be discussed further.

In keeping with the description of the parent unit 200 above, the child unit 300 may include a speaker 380 which permits the signal transmitting audio commands spoken by the parent to be heard from the speaker 380 on the child unit 300. The child unit 300 may further contain an associated microphone 370 for transmitting a signal representative of the child's voice from the child unit 300 to the parent unit 200 to be audible to the parent via speaker 280. The aforementioned tactile indication system may be a vibration type device incorporated into the child unit, similar to vibration devices used in pagers and cell phones as another way to alert the user of the child unit 300 to an instruction.

Child unit output indicating device 42 may include audio indicating portion 42*a*, and/or visual indicating portion 42*b*, and/or tactile indicating portion 42*c*. Audio indicating portion 42*a* may include, for example, in either digital or analog form, speech (recorded, synthesized, or a signal representative of an audible sound transmitted from the parent unit 200), musical tones (which can be combined to form musical compositions), or other sounds (including recorded natural sounds or electronically synthesized sounds), the audio indicating portion 42*a* could take the form of loudspeaker transducer 380. Visual indicating portion 42*b* may include, for example, in analog or digital form, control signals for activation of lamps or other light-emitting devices, still images or video images. Tactile indicating portion 42*c* can include, for example, conventional means to make the unit vibrate such as is present in cell phones and pagers.

Figure 3:
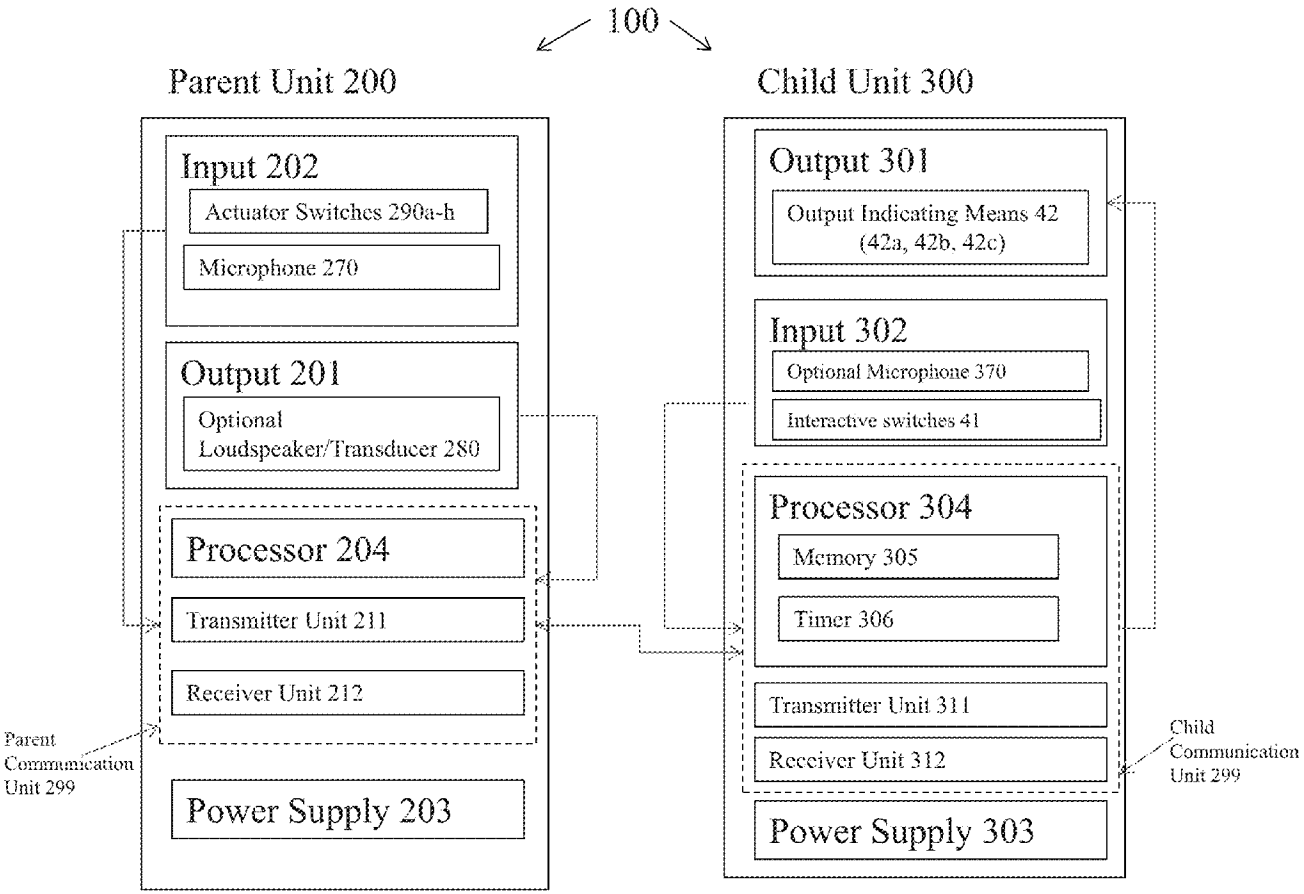
FIGS. 3 and 4 are Functional Block Diagrams of embodiments of an indicating system in accordance with the principles of the present invention.
Figure 4:
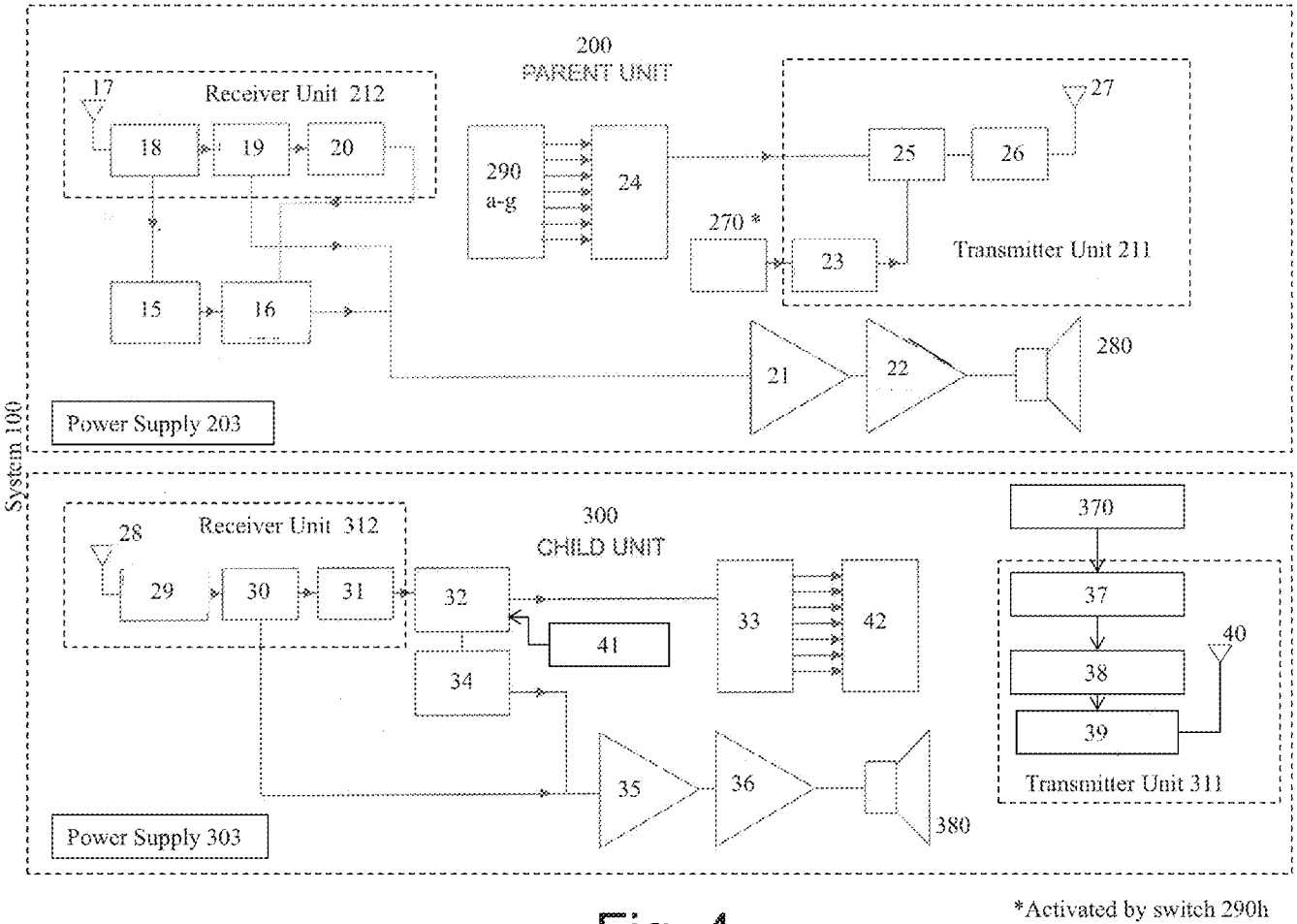

The parent unit 200 includes actuators 290*a-h* (e.g., for example, actuators or switches of any suitable type). Actuator 290*h* allows the user to transmit spoken words through microphone 270, to be transmitted to the child unit 300. The transmitter unit 212 may be physically located on the parent unit 200, as shown in FIGS. 3 and 4 which will be discussed further below and together with receiver unit 212 and/or processor 204, make up the parent communication unit (299). A corresponding receiver unit 311, may receive signals from remote actuators 290*a-h* and transmitter unit 312 is physically located on the child unit 300. The signal(s) may be communicated between the transmitter unit 211 and the receiver unit 312 (and vice-versa between transmitter unit 311 and receiver unit 212) without a physical link as is well known in the art of wireless devices, such as an electromagnetic signal (including radio frequency, infrared, or any other remote/wireless signal such as Bluetooth, WiFi or cell phone based signal transmission or an acoustical signal (including ultrasonic) or any other suitable method. In another embodiment the transmission could be via a physical link, such as an electrical signal carried by a conductor coupling parent communication unit 299 and child communication unit (399).

To operate the indication system, The user may turn on both the child unit 300 and the parent unit 200 via power switches 39 and 29, respectively. Activating power switch 29 or 39 not only enables the respective unit to be turned on, it may also initiate an audible, visual and/or tactile message to be provided to the child, such as "ready to go? Do you have your helmet on? If you do, push the helmet button.", with other accompanying sounds (e.g., a revving car engine), entertainment or educational features or educational messages. At this point, if the child does not have their helmet on, they have been encouraged to put their helmet on. Once they have their helmet on, they push the helmet on button 390*f* and the child unit 200 provides a celebratory visual, audible and/or tactile response 350 praising the child. At this point, the child is ready to begin riding their bike or other mobile apparatus. If the child does not indicate that they put their helmet on, after a set amount of time the message is repeated. As a power saving feature, after a set number of times of repeating the message (e.g., 1, 2, 3, 5 or 10), the child unit 300 may turn itself off or go into a sleep mode.

When the child is ready to begin biking, the parent activates the "Go" actuating switch 290*c* on the parent unit 200 which sends a signal via antenna 27 that is received by antenna 28 on the child unit 300 activating a visual and/or audio and/or tactile output via the output indicating device 42 on the child unit 300. The child may get excited when they see visual output indicator 390*c*, or hear or feel the corresponding visual or tactile indicator and begin biking. Once the child gets to a place that the parent wants them to stop, the parent may activate the "Stop" actuating switch 290*a*, which in the same manner as the prior discussed transmission method, activates a visual and/or audio and/or tactile output 390*a* on the child unit 300 (e.g., instruction, direction, notification or command). When the parent wants them to resume biking or otherwise moving, they can activate the "Go" actuating switch 290*c* on the parent unit 200, activating "Go" indicator 390*c* or visual and/or audio and/or tactile output on the child unit 300.

If, for example, the parent wants the child to move over to the right side of the trail because of on-coming traffic or to teach them proper biking manners, they can actuate switch 290*e* which may create a visual and/or audio and/or tactile output via the output indicating device 42, if visual, through indicator 390*e* on child unit 300 telling the child to move to the right. This direction providing feature is so much better than a parent yelling to the child to move to the right because often younger children can't remember their left from their right. Output indicator 390*e* may be in the shape of an arrow pointing to the right, helping them to learn their right from their left. The entire display/output indicating device 42 may be made educational in content to teach kids their colors, shapes, directions and so forth. The output indicators 42 may not only be made in various shapes as shown in FIG. 3, but the audible message corresponding to each indicator may name the color of the indicator or say what shape, or some other fact in order to make learning fun (in one or more modes (e.g., for example, educational mode or operational mode)).

FIG. 3 is a basic functional block diagram of the indicating system 100 of the present invention utilizing processor technology to control function of the device. The parent unit 200 may be supported by power supply 203 and includes input 202, processor 204, transmitter unit 211, receiver unit 212 and optional loudspeaker/transducer 280. The child unit 300 may be supported by power supply 303 and may include output portion 301, processor 304 (including memory 305 and timer 306), a receiver unit 312, transmitter unit 311, and loudspeaker/transducer 370. The transmitter and receiver units will be described in further detail below with regard to FIG. 4.

In response to user input via the actuators 290*a-h* in the input section 202 on parent unit 200, the parent unit 200 transmits a signal from transmitter unit 211 to the child unit 300 receiver unit 312, the processor 304 determines the output which is then displayed in output portion 301 via indicating portion 42*a-c*. The child unit 300 input 302 may include interactive switches 41 (such as the previously mentioned "do you have your helmet on button") which may signal the processor to cause a celebratory response via output portion 301 on the child unit 300, the celebratory response could include activation of any of the outputs 42 in a manner that would be pleasing to the child such as blinking of lights, pleasing sounds or messages and so forth. In another embodiment, any actuator provided on either the parent unit 200 or child unit 300 could be utilized in place of interactive switch 41 to cause the celebratory response.

In one or more embodiments, a microphone 370 on the child unit 300 may be provided enabling the child unit 300 to transmits a signal representative of an audible sound via the transmitter unit 311 to be received by receiver unit 212 housed on parent unit 200 which is then played back over optional loudspeaker/transducer 280 housed on the parent unit.

FIG. 4 is a functional block diagram of another exemplary embodiment of the indicating system 100 of the present invention (though many of the details discussed here may be applicable to the embodiment of FIG. 2*a* discussed above). The system 100 may include a parent unit 200 powered by power supply 203 (such as a battery) and a child unit 300 powered by power supply 303 (e.g., a battery or rechargeable battery). The parent unit 200 may function primarily as a transmitter has actuator switches 290*a-h*, an encoder/multiplexer 24, at transmitter unit which includes a modulator 25, a radio frequency transmitter 26 and an antenna 27. The child unit 300 may function as a receiving unit has an antenna 28 and radio frequency amplifier and tuner 29, a demodulator 30, a decoder section 31, a control logic section 32, display drivers 33 for the output portion 301, an audio storage and play back section 34 which may store one or more pre-recorded messages, an audio sum amplifier 35 and an audio power amplifier 36 to drive a loudspeaker or transducer 380 to playback the pre-recorded messages.

In another exemplary embodiment, either one or both the parent unit 200 and/or child unit 200 may be incorporated into a mobile device such as a mobile phone or other mobile device in the form of an app that functions as the invention is described (e.g., IPOD®, IPOD TOUCH®, IPAD® or any other mobile device).

In one exemplary embodiment including voice transmission from the parent unit 200 to the child unit 300, a signal representative of an audible sound transmitted from the parent unit to the child unit 300 is present (as opposed to or in conjunction with the use of pre-recorded messages), the parent unit 200 may also include a microphone 270, and may include actuator 290*h* to activate transmission of an audible sound, and audio section 23 feeding the modulator 25 for voice transmission to receive unit 312. The child unit 300 may contain an optional demodulator 30 or an optional feature in the demodulator to demodulate voice from the parent unit 200 and send to the power amplifier 36 driving loudspeaker transducer 380.

In one exemplary embodiment, the parent unit 200 may include a signal strength detector 15 and decoder 20 (e.g., signal strength, loss of signal, proximity detector, global positioning system (GPS) based, distance detector, or any other equivalent technology, in other embodiments the signal strength detector can reside on the child unit 300) that is capable determining when signal between the parent unit 200 and the child unit 300 drops below one or more predetermined levels, activating one or more levels of an out of range indicator 16 on parent unit 200 (e.g., for example, an indicator, alert or alarm communicating a loss of signal and/or out of range and/or nearing one or more a specified ranges or distances) to notify the user of the parent unit 200 when the parent unit 200 and child unit 300 are at a predetermined range or are out of range of transmission, such as an out of range alert similar to those used in baby monitors but may include notification that the units are out of range or nearing out of range, or at a specified range or distance apart on one, either or both of the child unit 300 and the parent unit 200. In one or more embodiments, the one or more levels of the out of range indicator 16 could be supplied as multiple indicators, or one indicator that changes color (e.g., red, orange, yellow, green etc), or an audible alert or alarm that changes volume, sound or harshness, or a tactile indication with a variety of responses or levels). Sensing of or activation of the one or more levels of an out of range indicator 16 on the parent unit may correspond to one or more responses by the output indicating device 42 of the child unit 300 which may communicate one or more protective instructions (e.g., first protective instruction at a first predetermined signal strength, a second protective instruction at a second predetermined signal strength, a third protective instruction at a third predetermined signal strength, a fourth protective instruction at a fourth predetermined signal strength, for as many levels as is needed, etc., and may also include one or more predetermined "safe range" signal strength levels that provide a non-protective instruction.). Yet another response by output indicating portion 42 on the child unit 300 may be configured to communicate "go" at a predetermined signal strength (e.g., this may be the strongest signal strength range).

In one exemplary embodiment, when the child starts to get out of range in which the parent unit 200 can communicate with the child unit 300, an output indicator, such as 390*a* may be activated on the child unit 300 and an audible, visual or tactile command given to inform the child that they need to stop and wait until the parent unit 200 gets closer to them. In another exemplary embodiment, the audible, visual or tactile command may indicate "prepare to stop" (e.g., when the child is at a specified range or distance, preventing them from getting too far away from their guardian or at an unsafe or undesirable distance for their age or abilities). The parent unit 200 also includes and out of range indicator 16 (FIG. 4) or other indication to inform them that their child is out of range. The range feature could be set at a fixed distance, multiple levels of distance, a modifiable distance, or based on the capabilities of the system, an input feature could be included on either or both the parent unit 200 or child unit 300 to enable the user to adjust this setting, or one or both units could be connected to a computer for programming the setting.

In one exemplary embodiment, in order to prevent cross communication with another device, signal interference protection may be incorporated into the device, such as multiple, selectable transmit and receive frequencies as is commonly used in baby monitors, or encoding the control signal so the transmit a receive code for a control command to be accepted must match as is commonly used in garage door openers, or any other known technology.

To enable the child unit 300 to communicate more fully with the parent unit 200 by enabling the child unit 300 to transmit a signal representative of an audible sound transmitted from the child unit, the transmitter unit 310 includes a microphone 370, audio preamp and processing unit 37, a modulator 38, transmitter 39 and antenna 40. The signal representative of an audible sound may be received at the receiver unit 212 located on the parent unit 200. The receiver unit 212 may include Rx antenna 17, radio frequency amplifier and tuner 18, demodulator 19 and decoder 20. The signal may then pass through audio sum amplifier 21 and audio power amplifier 22 to be heard via loudspeaker transducer 280.

Figure 5:
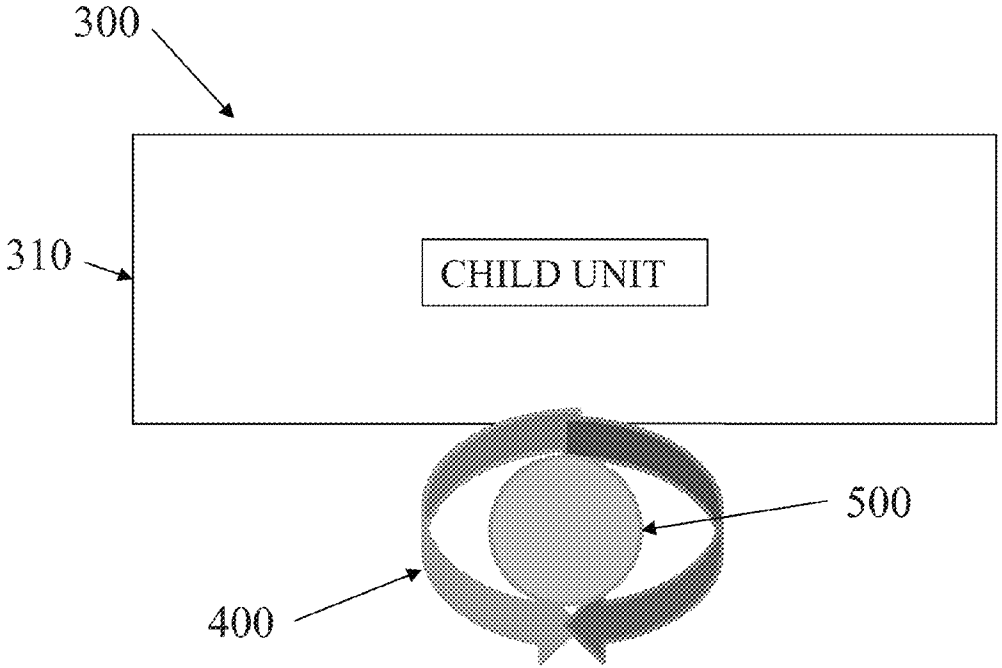
FIG. 5 is a side view of a child unit depicting an example for coupling the child unit to a mobile apparatus such as a bike, in accordance with the teachings of the present invention.

Referring to FIG. 5, in order to use the indicating system 100, a user couples the child unit 300 either directly or indirectly to a mobile apparatus temporarily, permanently, or could be incorporated into the mobile apparatus itself, such as a bike, big wheel, kids battery operated car, go-kart, (All Terrain Vehicle) ATV, snow mobile or scooter, though it is contemplated that the device could be attached to the child themselves or another apparatus in the form of a wristwatch type device or other means. One or more attachment means may be provided to make the mounting versatile to several mounting schemes. The components of the device could be combined into one housing or exist as individual parts in various places on the bike which are communicable with each other via wired or wireless means. The parent unit 200 may be attached to or in contact with the parent (or other user), a stroller, a bike the parent is riding etc. via any means known to be used for hand held electronic devices such as: belt clips, wrist watch type attachment, a lanyard, putting it in a pocket, setting it in a stroller cup holder or bin, carrying in a purse. FIG. 5 shows a simple attachment 400 of the device to a bike via the handlebar assembly 500. This could be done via a clamp type system, hook and loop fasteners a band of material with grip on the surface which is in contact with the handlebar that can be substantially tightened, conventional methods for attaching a toy to a crib bar or many other known methods have been contemplated. A fastening means which prevents rotation of the device about the handlebars or other attachment point may be provided.

Figure 6:
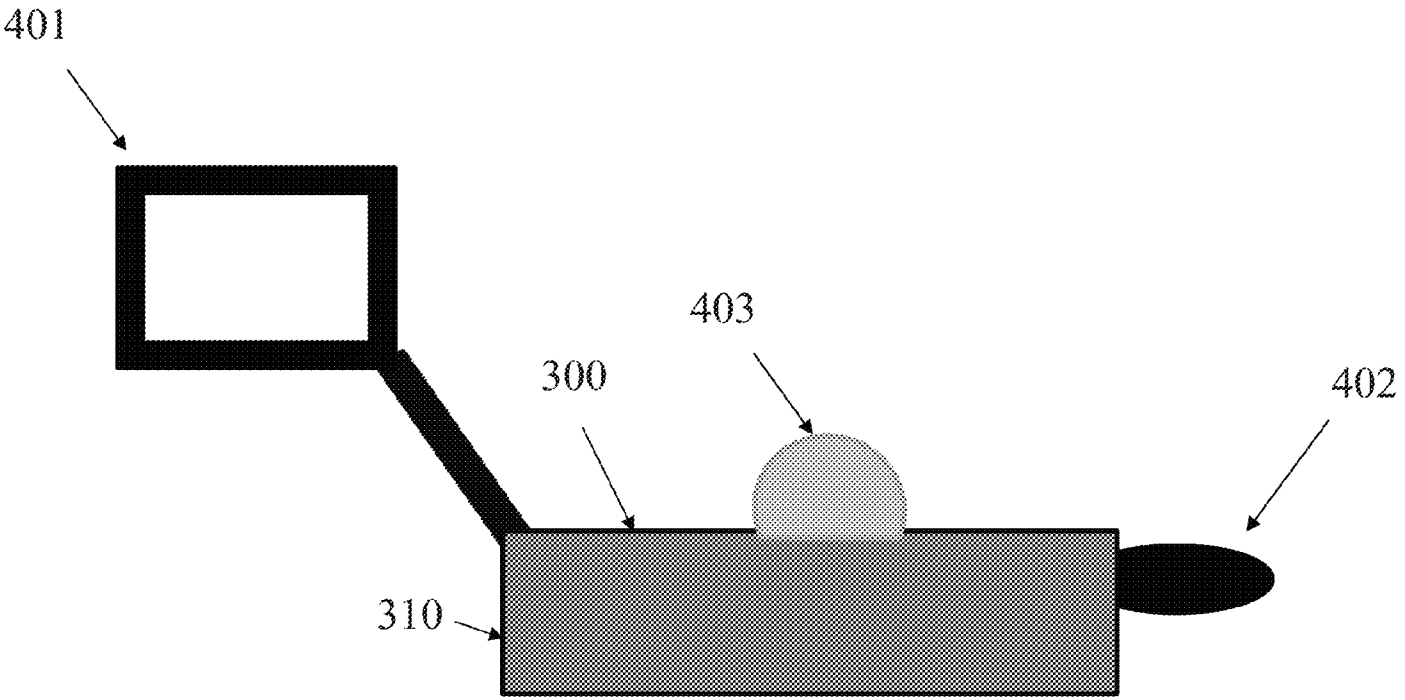
FIG. 6 is a side view of a child unit depicting optional features/accessories in accordance with the teachings of the present invention.

FIG. 6 depicts other features that may be incorporated into the device. These options useful to teaching children good bike riding and transportation habits include a side view mirror 401, or an actuator for a bell (e.g., mechanical noise maker) or an electronic noise making device 402 to alert people in front of them that they are passing them. The electronic noise making device 402 may utilize the existing loudspeaker transducer 380 for creating the sound, or a separate speaker facing forward and away from the child so as to project the sound in the direction of the person they are passing rather than at the child riding the bike. A headlight or reflector 403 may be included so as to improve visibility of the child to others, or visibility of the pavement or trail to the child (e.g., for example, when riding in dim light). Incorporating these features into the device enhances safety and eliminates the need to purchase or attach these items separately.

In some embodiments, the educational features expressed via output 42 on the child unit may be extended to any level desired. For example, the device could provide educational messages such as "to stop your bike, pedal backwards hard or use your hand brake if you have one", "stop signs are red", "the shape of a stop sign is an octagon, it has 8 sides". These educational messages could be played not just upon activation of an actuator switch 390*a-g* on the parent unit 200, but could be played at the beginning or end of each use of the device and the message could be rotated or randomly selected. These reminders keep the user safer by reminding them at a time when they are not moving how to properly operate their mobile apparatus.

In other exemplary embodiments, other features contemplated include volume control on either or both units 200 and/or 300. The volume control element for each of the units could reside on each individual unit, or for instance, the volume control element for the child unit 300 may reside on the parent unit 200 so that the parent may adjust the volume remotely from the child. The same type of adjustment could also be included for adjusting brightness of the output indicators 390*a-g* on the child unit 300 to account for different levels of light in the environment, making it easier to view the visual output, or to preserve battery life as desired.

Additional interactive switches may be included to provide the most game-like environment possible, while increasing the likelihood of cooperation of the child with the parent. Such as an "all done button" on the child unit 200, or the parent unit 300, which when activated may cause a celebratory response on the child unit like that previously mentioned for the "helmet on" button 390*f*. The pre-recorded message might say something like "Great job today, don't forget to put your helmet and bike away big kid!". The interactive switches could be used to encourage any desirable behavior or habit (e.g., for example, stretching or drinking water).

In one exemplary embodiment, a feature for turning on the device other than the user having to turn on the device via power switch 29 as shown in FIG. 1*a* have been contemplated. The power switch 29 may be a contact or other suitable switch in the seat or elsewhere on the mobile apparatus that turns on the device when depressed by a user sitting on the seat. Such a sensor or switch may be in communication with the child unit 300 via hardwire means or other wireless means as previously discussed for communication between the parent unit 200 and child unit 300. A timer and filter may be used in order to determine whether the user is just standing up and riding the device for a period of time, or whether they have gotten off the mobile apparatus. Other suitable means for determining whether the device is in use and to turn it on or bring it out of a sleep mode include accelerometers or angle measuring means, proximity sensor or any other suitable sensor or switch to determine if the bike is moving, not moving, standing up, laying on the ground or if the mobile apparatus is in use or not (e.g., use status). This information may also be used to remind the user to put their bike away or play celebratory messages and so forth.

In a further exemplary embodiment, rather than finger actuated actuating switches 290*a-h* on parent unit 200, one or more of the actuation switches 290*a-h* could be replaced with any method of actuation including movement based actuators or sensors (e.g., for example, accelerometers, displacement measuring sensors, strain gages or in a similar manner to the technology used in WII® video game remotes). For example, in this embodiment, moving the parent unit 200 in an up and down direction may transmit a signal to the child unit 300 to communicate "stop". Moving the parent unit to the right may transmit a signal to the child unit to communicate "move to the right". Moving the parent unit to the left may transmit a signal to the child unit 300 to communicate "move to the left". Further, moving the parent unit 200 in a circle or in an upward direction may communicate "turn around" or "come back". Any combination of useful messages may be communicated via any combination of movements.

The figures depict a very basic housing for the invention, in one or more exemplary embodiments, the display may be presented in an ergonomic manner; the display should be placed such that the child is able to keep their focus on what is in front of them and where they are going rather than looking down.

FIGS. 8*a*-8*f*, show an embodiment of a device that enables a parent unit 200 to share instructions, commands or praise with a child unit 300 while minimizing cost by simplifying the unit is considered. FIGS. 8*a*-8*f* exemplify just a few of the possible embodiments of the child unit 200, though it should be appreciated that all of the features described herein could be combined or separated as desired. In each embodiment, the parent unit 300 may contain the necessary corresponding features needed to operate the child unit 200 as is shown in each of the FIGS. 8*a-f* as previously discussed, but are not specifically shown for the sake of brevity.

Figure 8A:
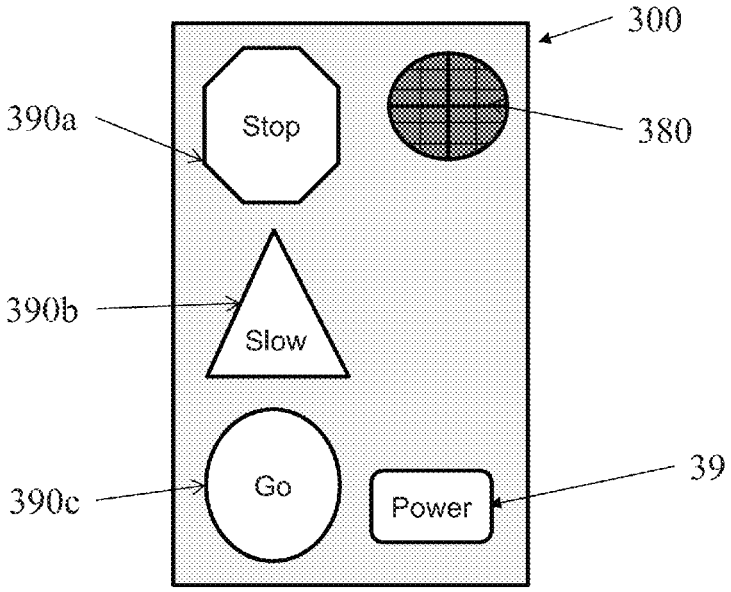
FIGS. 8*a-f* are plan views of a child unit of the system in alternate embodiments in accordance with the teachings of the present invention.

For example, FIG. 8*a* shows an embodiment focused on communicating "stop", "yield" and "go" via output indicators 390*a-c*.

Figure 8B:
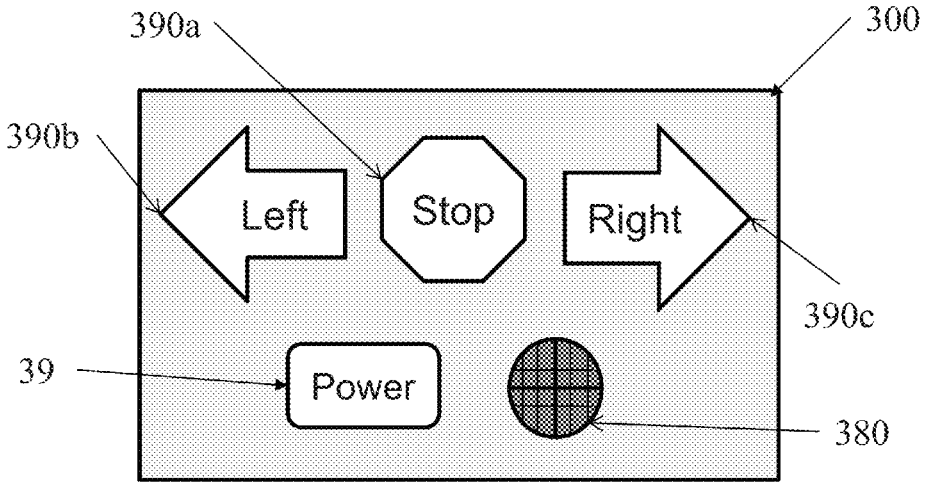

FIG. 8*b* focuses on communicating moving to the left or right or stopping via indicators 390*a, d-f*.

Figure 8C:
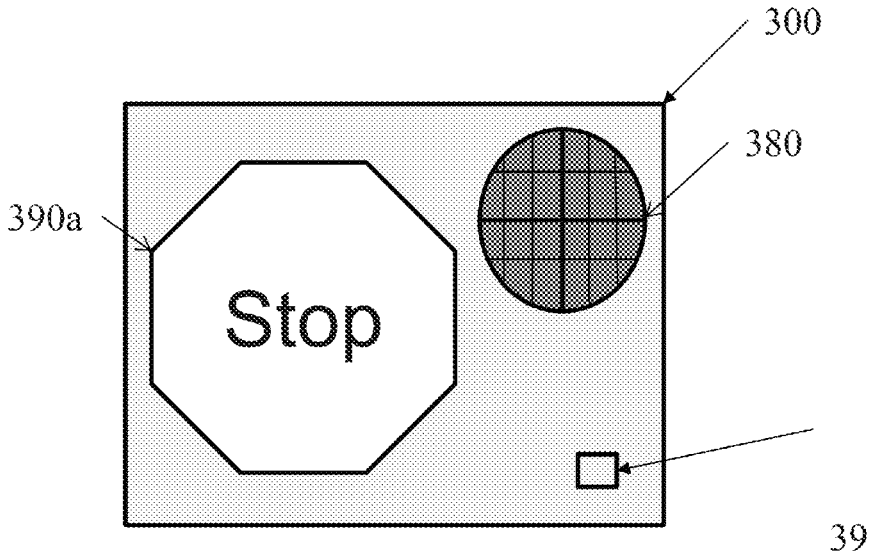

FIG. 8*c* shows a visual "stop" output indicator 390*b*. FIG. 8*c* also shows an optional loudspeaker transducer 380 that plays an audible pre-recorded message (e.g., for example, stop) or an audible transmission signal from the parent unit 200.

Figure 8D:
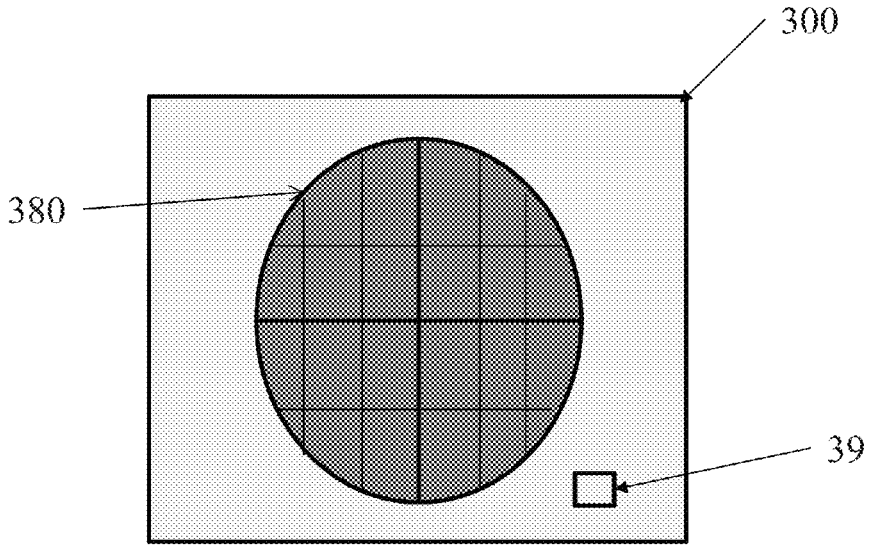

FIG. 8*d* is an embodiment with only audible indication, provided either as pre-recorded messages operated via any of the actuation switches 290*a-g* on the parent unit 200 that corresponds to output indicators 390*a-g* on the child unit 300, and/or as a signal representative of an audible sound picked up by microphone 270 and transmitted from the parent unit 200 to the child unit 300 to be played via loudspeaker transducer 380.

Figure 8E:
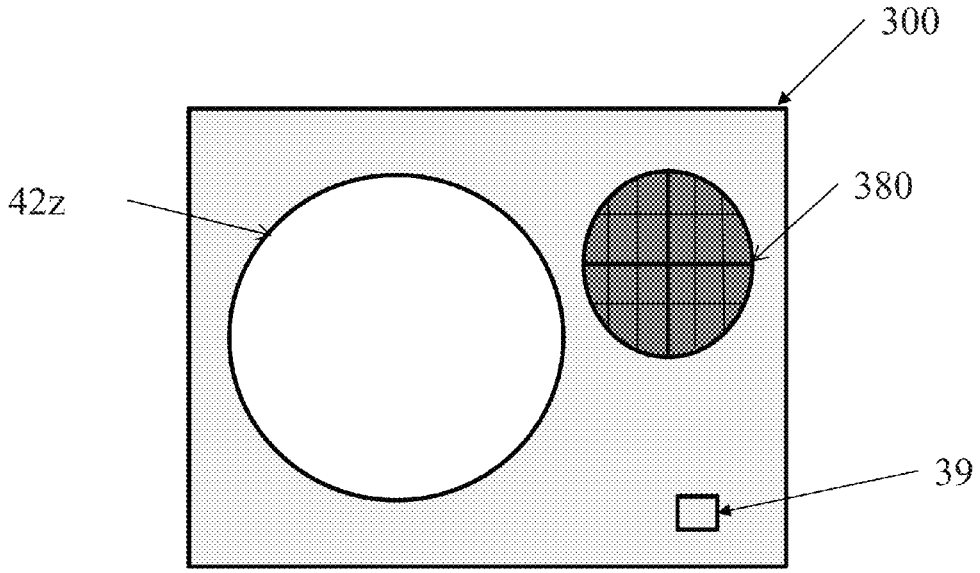

FIG. 8*e* is an embodiment wherein the child unit contains with one general/central output indicating device 42*z* and a speaker 380. The general indicating portion 42*a* may be an LCD screen or a combination of different colored LED's where only certain color LED's, strategically placed, are activated to display an output to convey a message such as "Stop" or an octagon displayed in red, "Go" displayed in green, "Slow" or a triangle displayed in yellow, this may be extended to all instructions that are desired to be provided. Again, speaker 380 can be operated as discussed with regard to FIG. 8*d*. Alternatively, the Parent unit could contain all the features as shown in FIG. 2*b*, including actuators 290*a-g*, while using the general indicating portion 42*a* to convey all the different messages.

Figure 8F:
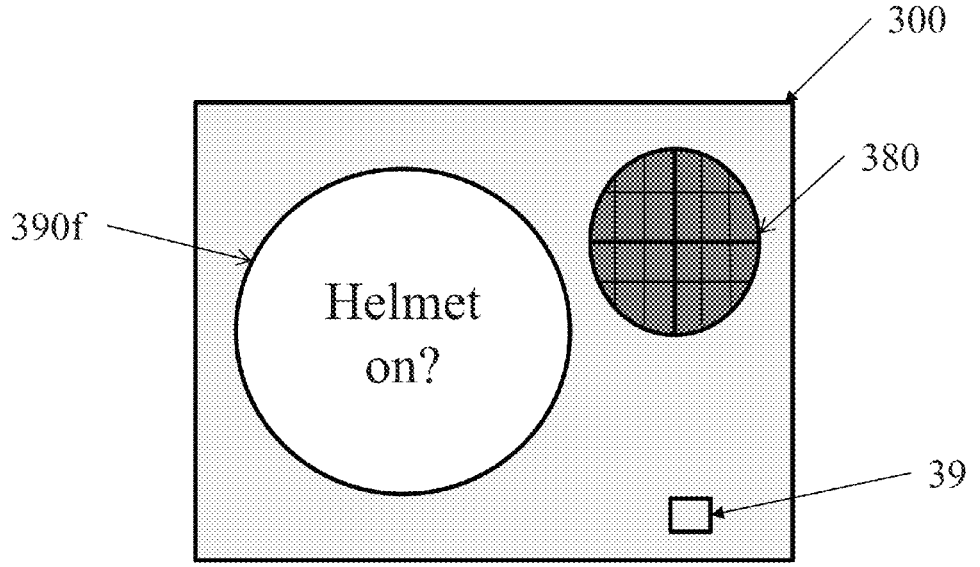
Figure 9A:
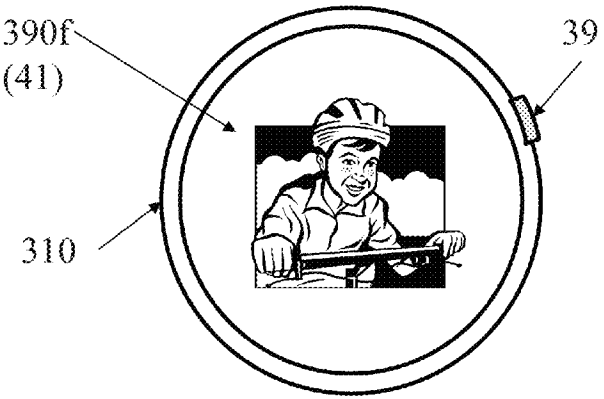
FIGS. 9*a*-9*d* show additional, non-remote embodiments of the device.
Figure 9B:
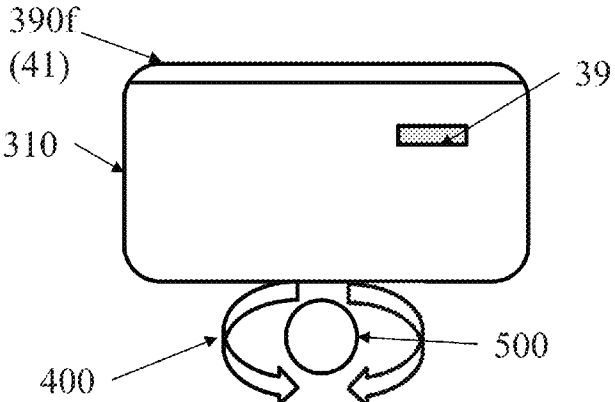
Figure 9C:
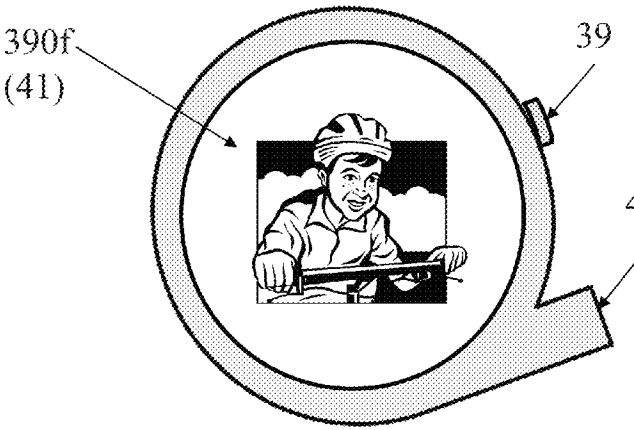
Figure 9D:
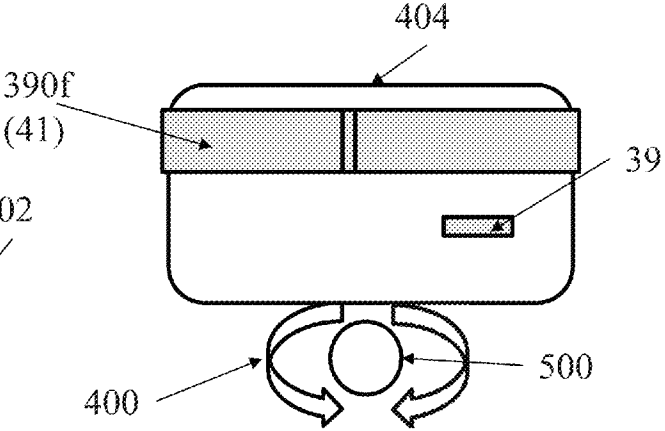

The embodiment of FIG. 8*f* includes a power switch 39, a helmet on button/good job button 390*f*, and a loudspeaker transducer 380. The embodiment of FIG. 8*f* helps encourage helmet wearing and also good riding habits by allowing the parent to provide praise or verbal instructions picked up via microphone 270 when the actuator switch 290*g* is actuated, transmitting a signal representative of an audible sound to be played on loudspeaker transducer 380, without the parent having to yell.

Although several embodiments have been disclosed above, any combination of features disclosed herein can be used in any combination to create additional embodiments as pertains to the specific needs of a particular market of individuals, or to meet a given size of the device or cost limitations etc.

In order to reduce cost and still communicate information to a child or other individual on a bike has been considered. Therefore additional embodiments combining and eliminating the various features of the device is of great importance.

Embodiments which do not include the transmission of signals (communication) feature between a parent unit 200 and a child unit 300, but rather using the child unit 300 alone (eliminating the transmission features) have been considered. FIG. 9*a*-9*d* shows embodiments in which the device utilizes the helmet reminder feature alone (9*a*-*b*), or in conjunction with an alert bell 402 (9*c*-*d*) as is commonly used to alert other riders that the user is passing them (ie: bell or horn or other noise making device, mechanical or electrical in nature). The device may include other interactive switches 41 (such as 390*f*, helmet on button) that are not dependent on transmissions from a parent unit. Upon turning on of the device via switch 39, or other known means to turn on the device or bring the device out of a sleep mode or off position, the child would be prompted to put on their helmet, if the child has put on their helmet, they are asked to depress the helmet button 390*f*, upon doing so, the unit does an audio and/or visual and/or tactile celebration or celebratory response, as in the manner described in the full featured device above. As mentioned above, there may be other interactive switches 41, such as an all done or bike put away actuator, which could ask, "did you put your bike away? If you did, hit the button, at which time the unit provides a celebratory response. It could also encourage other behaviors previously mentioned such as stretching and drinking water.

Figure 10:
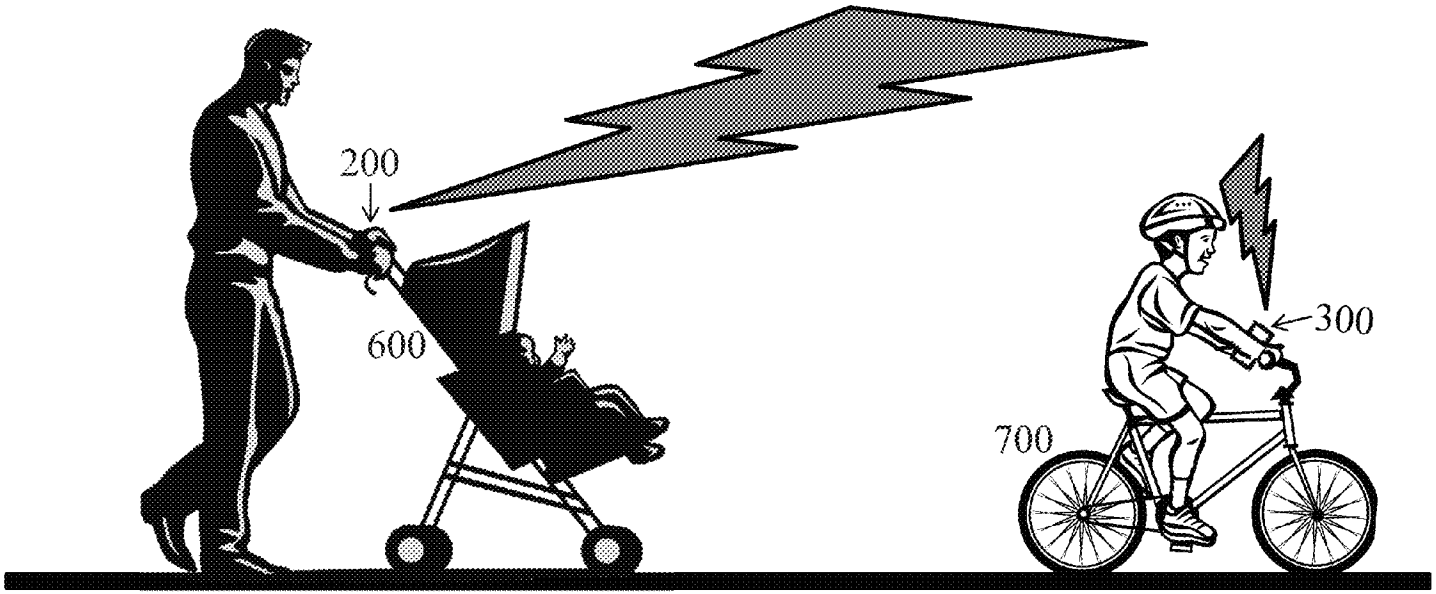
FIG. 10-12 are general illustrations of how the indicating system in accordance with the principles of the present invention could be used.
Figure 11:
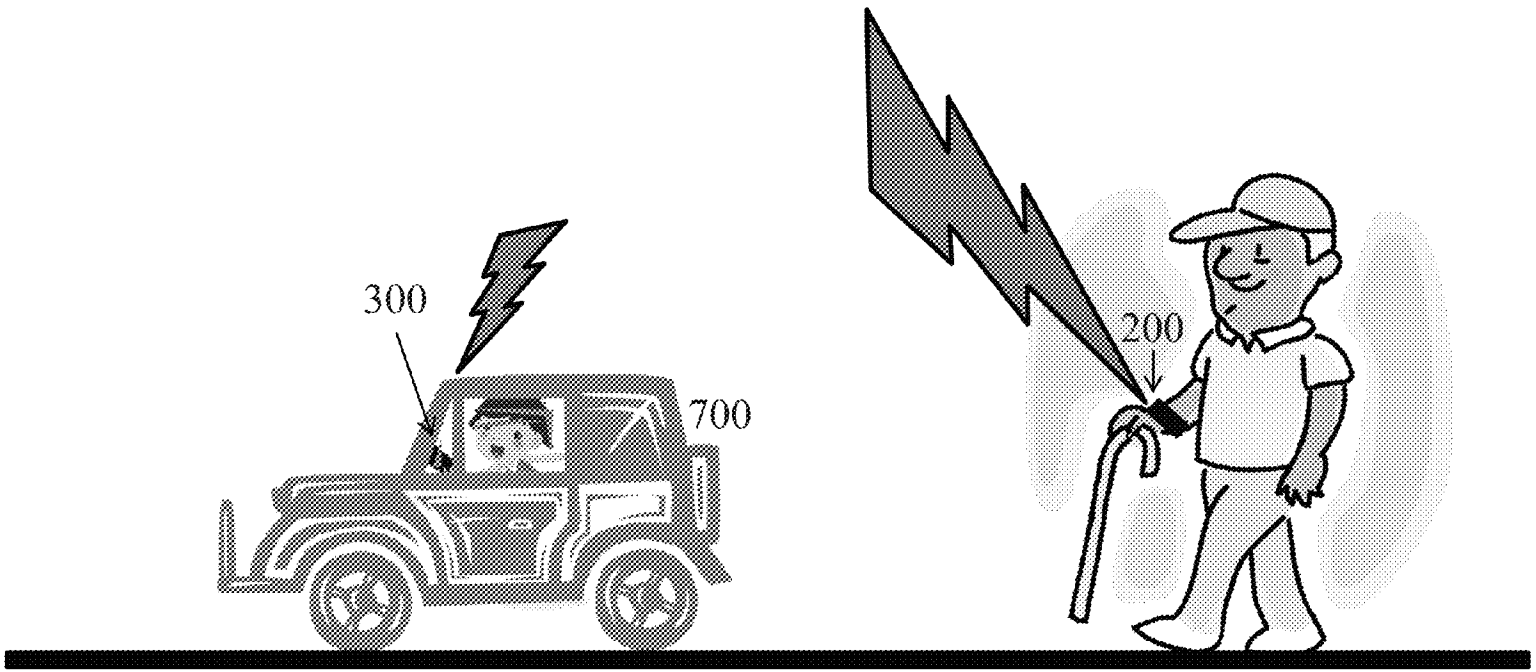
Figure 12:
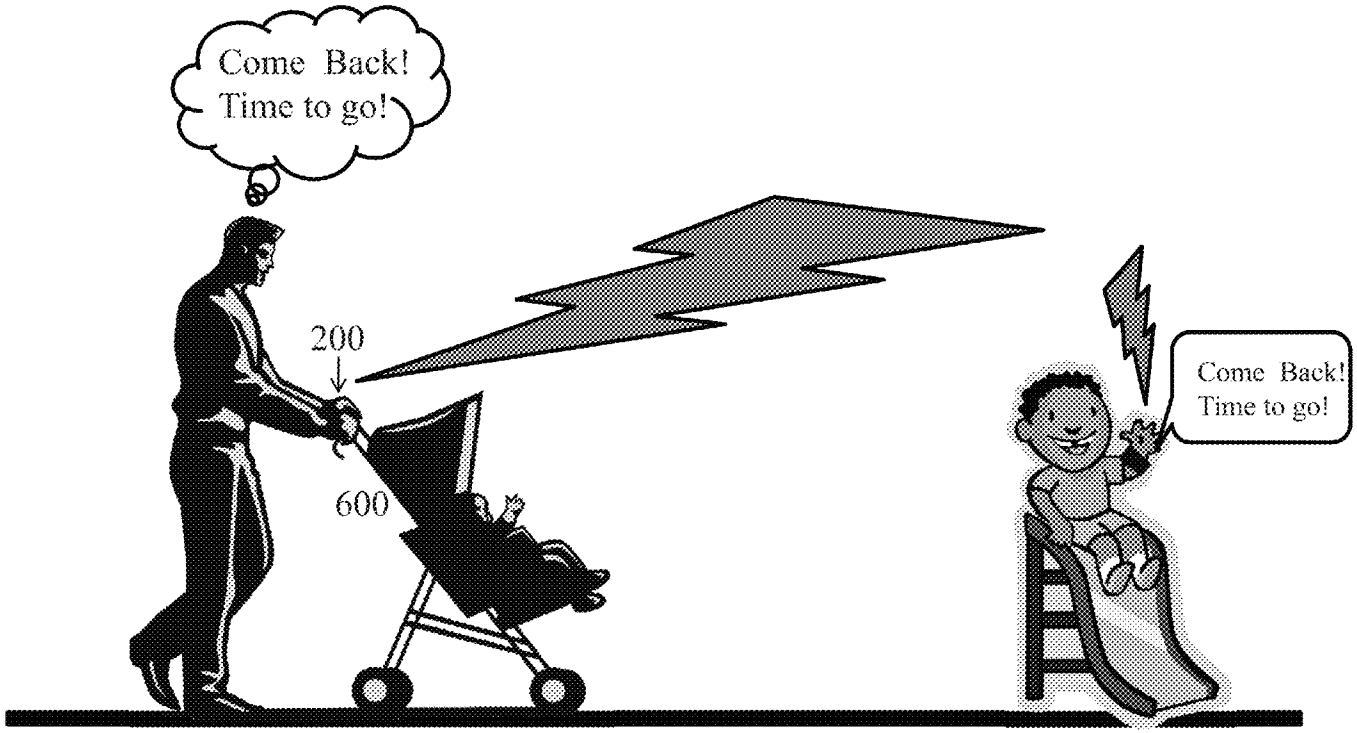

FIGS. 10-12 show examples of potential situations where the indicating device would be useful. In this case, the parent unit 200 resides with the parent, possibly attached to the parent's wrist, sitting in a cup holder of the stroller or attached to/incorporated into the stroller 600. The child unit 300 resides with the child who is walking, riding, or otherwise moving. The device could be made in various sizes and attached to the child's wrist or attached to/incorporated into the bike or other mobile device 700. Signals are transmitted from the parent unit 200 to the child unit 300 and vice versa. FIGS. 10-12 show situations where the child is being attended to someone who may not be able to keep up with the child, maybe they are pushing another child in a stroller, or are a slower moving individual making the device even more helpful. These are but a few potential uses of the indicating device as considered for use between adults and children. Communicating between two adults on bikes and situations that pose similar communications hurdles would be equally relevant uses of the indicating device. It is also contemplated that a waterproof embodiment designed for tubing or waterskiing might be used, possibly with the features of the parent and child units reversed so that a child behind a boat can communicate more easily to the parent/driver if they want to slow down, speed up, stop, or turn and so forth. It is also considered that a waterproof wrist watch or suit attachable version for taking kids to the beach or swimming would also be desirable.

Figure 13:
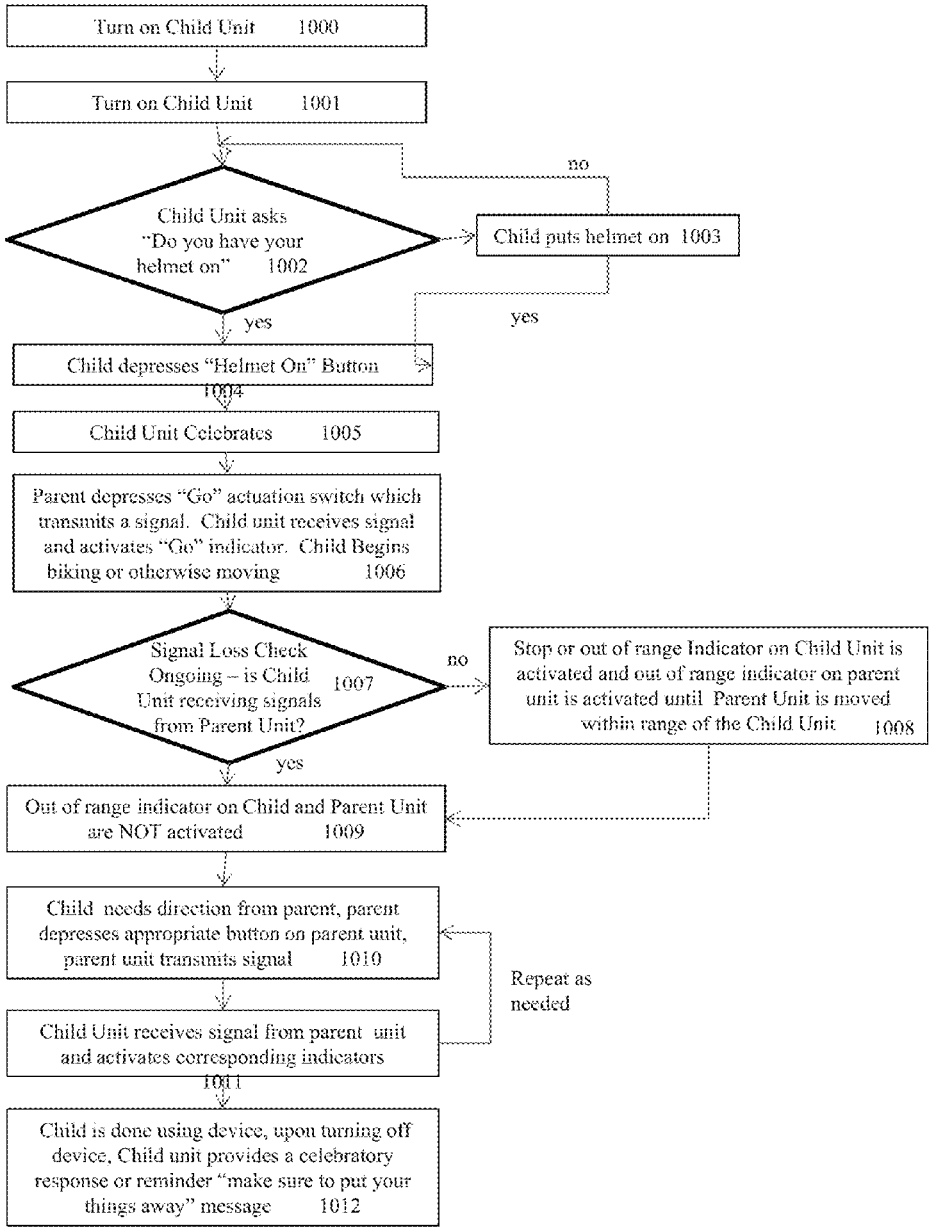
FIG. 13 is a flow chart depicting the basic method of using a first physical embodiment of the indicating system according to the present invention.

A first physical implementation of an embodiment of the present invention is now described with reference to FIGS. 1*a*, 1*b*, 2*a*, 2*b*, 3 and 4 and the basic method as shown in FIG. 13. The description provided merely sets forth a potential embodiment. However, it is important to note that all features disclosed could be incorporated into one more complicated device, or a minimal number of features could be utilized for the particular application so as to meet the spirit of the invention while reducing cost.

In accordance with the present embodiment, the parent unit 200 includes various actuators 290*a*-*g* or other activation means, that when activated, transmit a signal command, or transmit a signal representative of an audible sound transmitted from the parent unit 200, to the child unit 300. The child unit 300 is responsive to receiving a signal to activate a command comprising a visual and audio indication, and receive and signal representative of an audible sound transmitted from the parent unit 200.

In accordance with the present embodiment, the parent unit 200 includes a power switch 29 and other actuation switches 290*a*-*g*, which when activated, transmit visual and/or audio and/or tactile commands and the like to the child including, but not limited to: "stop" 290*a*, "slow down/caution/yield" 290*b*, "go"290*c*, "move to the left" 290*d*, "move to the right" 290*e*, "good job" 290*f*, "come back/make a U-turn" 290*g*. Other contemplated actuators include transmitting information to the child that parents commonly give children such as "10 more minutes of play", "5 more minutes of play", "playing time is up" etc. The parent unit 200 includes a voice command switch 290*h* and an associated microphone 270 for transmitting audio commands spoken by the parent to the child unit 300, alone, or in conjunction with an associated audio and visual indicators on the child unit 300 to provide more specific information.

In accordance with the present embodiment, the child unit 300 is responsive to receiving a control signal representative of a particular command or the like transmitted from the parent unit 200 when any of actuation switches 290*a*-*g* are activated. As such, the child unit 300 includes a speaker(s) 380. The child unit communicates the desired command to the child, either via a pre-recorded message, or any of the actuation switches 290*a*-*g* or 290*h* may enable the child unit 300 to receive a signal representative of an audible sound transmitted from the parent unit 200. This allows the parent to provide a more specific command captured by microphone 270 to be transmitted and played through speaker 380 on child unit 300. Visual and audio indication is provided by output indicators 390*a*-*g*. When one of the actuation switches 290*a*-*g* on the parent unit 200 is activated, a signal may be transmitted to the corresponding output device 390*a*-*g* on the child unit 300.

In accordance with the present embodiment, visual indicating portion 390*a*-*g* may include, but aren't limited to, light-emitting diodes (LED's), lamps, fiber optics or an LCD screen(s). The child unit 300 may have output indicating device which correspond to each button or other actuating means on the parent unit 200 as shown in FIG. 2*b*, including instructions on the child unit such as, but not limited to: "stop" 390*a*, "slow down/caution/yield" 390*b*, "go" 390*c*, "move to the left" 390*d*, "move to the right" 390*e*, "good job" 390*f*, "come back/make a U-turn" 390*g*. The output can be extended beyond a command, for example, indicating portion 390*a* could be educational as well, the indicating portion could be in the shape of a stop sign, the device could instruct the child to "pedal backwards or apply the handbrake" or the message could say "a stop sign is red", "the shape of a stop sign is called an octagon, an octagon has 8 sides".

In accordance with the present embodiment, child unit output indicating device 42 may include audio indicating portion 42*a* and visual indicating portion 42*b*. Audio indicating portion 42*a* may include, for example, in either digital or analog form, speech (recorded, synthesized, or a signal representative of an audible sound transmitted from the parent unit 200), musical tones (which can be combined to form musical compositions), or other sounds (including recorded natural sounds or electronically synthesized sounds), it is contemplated to use the voice of popular children's characters to provide the most game-like environment possible. The audio indicating portion 42*a* may take the form of loudspeaker transducer 380. Visual indicating portion 42*b* can include, for example, in analog or digital form, control signals for activation of lamps or other light-emitting devices, still images or video images In accordance with the present embodiment, the parent unit 200 may include actuation switches 290*a-h*. Actuator 290*h* allows the user to transmit spoken words through microphone 270, to be transmitted to the child unit 300. The transmitter unit 212 is physically located on the parent unit 200. A corresponding receiver unit 311, which receives signals from remote actuators 290*a-h* and transmitter 211 is physically located on the child unit 300. The signal(s) can be communicated between the transmitter unit 211 and the receiver unit 312 (and vice-versa between transmitter unit 311 and receiver unit 212) without a physical link as is well known in the art of wireless devices, such as an electromagnetic signal (including radio frequency, infrared, or any other remote/wireless signal such as Bluetooth, WiFi or cell phone based signal transmission or an acoustical signal (including ultrasonic). In another exemplary embodiment, the transmission may be via a physical link, such as an electrical signal carried by a conductor coupling the transmitter unit 212 and the receiver portion 310. In a further exemplary embodiment, parent unit 200, rather than the user actuating switches 290*a-h* on the parent unit, one or more of the actuation switches 290*a-h* could be replaced with movement based sensors (e.g., for example, accelerometers, displacement measuring sensors, strain gages or in a similar manner to the technology used in WII® video game remotes). In this embodiment, moving the parent unit 200 in an up and down direction may transmit a signal to the child unit 300 to communicate "stop". Moving the parent unit to the right may transmit a signal to the child unit to communicate "move to the right". Moving the parent unit 200 to the left may transmit a signal to the child unit 300 to communicate "move to the left". Further, moving the parent unit 200 in a circle or in an upward direction may communicate "turn around" or "come back". Any combination of useful messages may be communicated via any combination of movements.

An embodiment of the method of using the present invention will be described with reference to the basic method as shown in FIG. 13 and supported by FIGS. 1*a*, 1*b*, 2*a-b*, 3 and 4. In Steps 1000 and 1001 the user turns on child unit 300 and parent unit 200, via switches 29 and 39, respectively. Activating the power switch 39 on the child unit 300 not only enables the unit to be turned on, it can also cause an audible and visual message to be provided to the child (step 1002), such as "ready to go? Do you have your helmet on? If you do, push the helmet button.", with other accompanying sounds, such as a revving car engine. At this point, if the child does not have their helmet on, they have been encouraged to put their helmet on without being nagged by their guardian. Once they have their helmet on, they push the helmet on button 390*f* (Step 1004) and the child unit 200 provides a celebratory visual, audible and/or tactile response 350 praising the child (Step 1005). At this point, the child is ready to begin riding their bike or other mobile apparatus. If the child does not indicate that they put their helmet on (Step 1003), after a set amount of time Step 1002 is repeated as needed until Step 1004 is completed (however, after an extended amount of time with no response, the unit(s) may shut off or go into a sleep mode).

At Step 1006, when the child is ready to begin biking, the parent activates the "Go" actuating switch 290*c* on the parent unit 200 which sends a signal that is received by antenna 28 on the child unit 300 activating a visual and audio output via the output indicating device 42 on the child unit 300. The child gets excited when they see visual output indicator 390*c*, or hear or feel the response and begins biking. Step 1006 continues as long as the user of the parent unit 200 chooses to communicate with child unit 200. For example, Once the child gets to a place that the parent wants them to stop, the parent can activate the "Stop" actuating switch 290*a*, which in the same manner as the prior discussed transmission method, activates a visual and audio output 390*a* on the child unit 300. When the parent wants them to resume biking or otherwise moving, they can again activate the "Go" actuating switch 290*c* on the parent unit 200, activating a visual and/or audio and/or tactile output 390*c* on the child unit 300.

Continuing with step 1006, if, for example, the parent wants the child to move over to the right side of the trail because of on-coming traffic or to teach them proper biking manners, they can actuate switch 290*e* which will create a visual and/or audio and/or tactile output via the output indicating device 42, if visual, through indicator 390*e* on child unit 300 telling the child to move to the right. This direction providing feature is much improved compared to a parent yelling to the child to move to the right because often younger children can't remember their left from their right. Output indicator 390*e* is in the shape of an arrow pointing to the right, helping them to learn their right from their left. The entire display/output indicating device 42 can be made educational in content to teach kids their colors, shapes, directions and so forth. The output indicators 42 are made in various shapes as shown in FIG. 2*a*, and the audible message corresponding to each indicator can name the color of the indicator or say what shape, or some other fact in order to make learning fun.

At Step 1007, a signal loss check is continually or intermittently ongoing between the Parent Unit 200 and Child Unit 300. If the units are out of range of each other (Step 1008) an out of range indicator 16 on the Parent Unit 200 and an out of range indicator (such as stop indicator 390*a*) on the Child Unit 300 is activated until the Units are moved within range of each other (Step 1009). It is considered that the out of range indicator 16 or a pre-alarm indication may be set to come on when units 200 & 300 are a specified distance from each other rather than upon actual signal loss (as in the previously discussed signal strength level). This enables the parent to train a child about what distance from the parent is permitted and can be increased as the child grows more responsible. This feature also relieve the parent from constantly providing feedback making for a more enjoyable, safer experience. Use of the device continues at Steps 1010 and 1011 which are essentially a continuation of the normal operation as discussed in Step 1006.

At Step 1012, when the child is done using the device, upon turning off child unit 300, the child unit 300 may provide another celebratory response and reminder such as "make sure to put your things away, great job today, didn't we have fun?" message.

Figure 14:
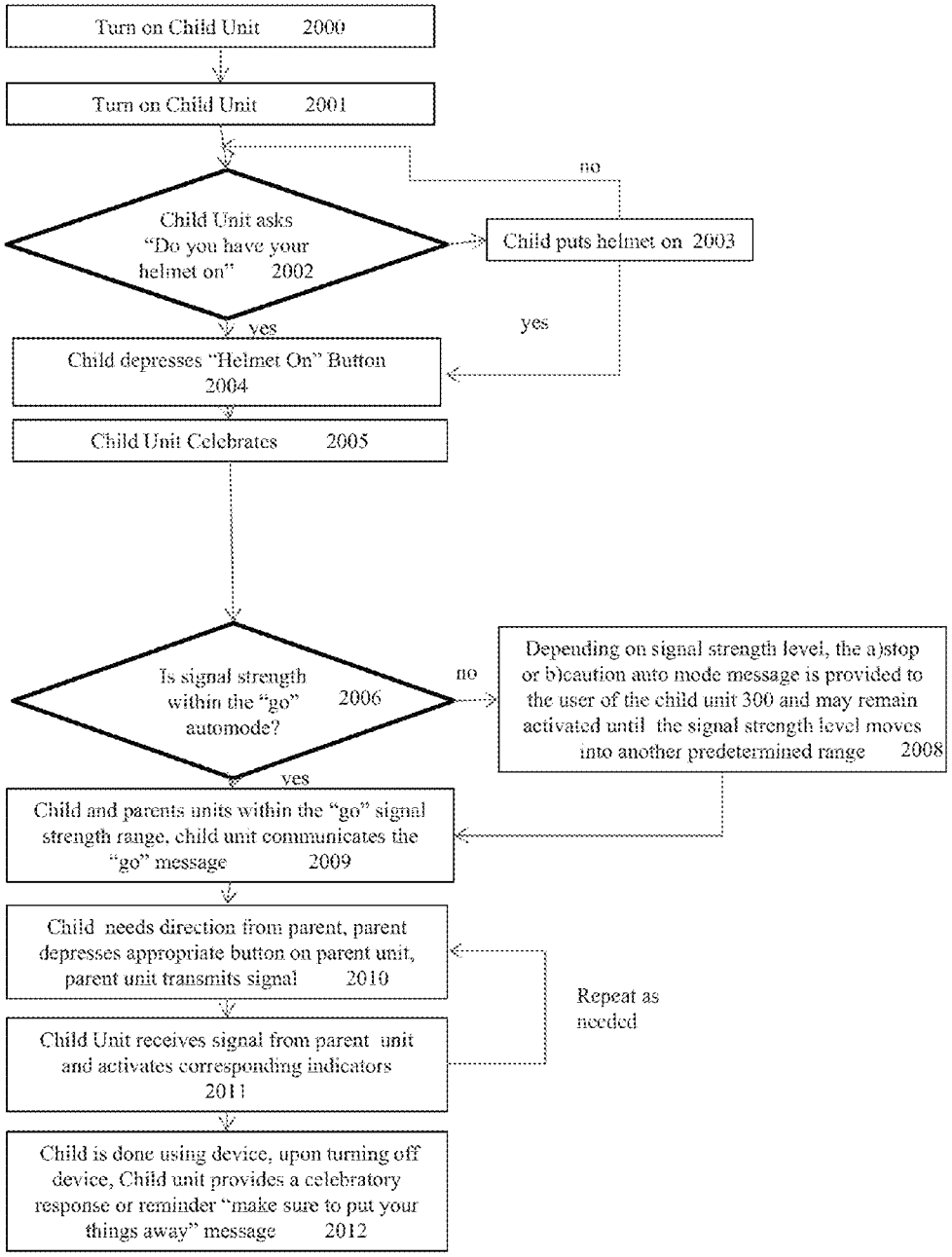
FIG. 14 is a flow chart depicting the method of using a second physical embodiment of the indicating system according to the present invention.

A substitute for step 1007 of the method may be made. Any number of levels of go, caution and stop may be automatically communicated to the user of the child unit 300 via indicators 390*a-c* based on signal strength level, as previously discussed. The signal loss or signal strength level check method of the following embodiment of FIG. 14 (auto mode) can be expanded to more levels as previously discussed in reference to the previous system disclosure and as shown in the steps of FIG. 14, or the method may include a combination of the auto mode of FIG. 14 (to be discussed) used in conjunction with the method of any of the one or more actuators 290*a-h* on the parent unit as discussed herein (e.g., the stop, caution and go indicators transmitted from the parent unit to the child unit communicated in auto mode as described in FIG. 14), while any of the turn/move left indicator (390*d*), or turn/move right indicator (390*e*), or make a u-turn indicator (390*g*) may be communicated via one or more actuators (290*e*, 290*d*, 290*g*) on the parent unit 200. Features of the various embodiments may be interchanged as desired to provide the best configuration based on customer requirements and desires, while keeping costs down. A combination of manual actuation of the left/right/u-turn indicators (290*e*, 290*d*, 290*g*) and the auto mode for the (go/stop/caution indicators 290*a-c*) may be very desirable.

In one embodiment of the method, as shown in FIG. 14 and supported by FIGS. 1*a*, 1*b*, 2*a-b*, 3 and 4, the transmission of signals is similar, but may be provided to the child unit 300 in a more automatic way, this is referred to as auto mode, which may be in addition to the educational mode (for purposes of educating-may have various levels for users with different levels of ability) and an operational mode (e.g., normal operation-may have various levels for users with different levels of ability). Auto mode may use the signal strength level (or other related technology) between the parent unit 200 and the child unit 300 to determine an appropriate instruction to provide the user of the child unit 300 (e.g., it is feasible in this embodiment that the actuators on the parent unit 200 may be reduced or eliminated for a device comprising auto mode because signal transmission to the child unit 300 may be provided based on predetermined signal strength levels (e.g., one or more fixed or adjustable levels which may be reflective of a distance that the user of the child unit 300 is from the user of the parent unit 200).

In Steps 2000 and 2001 (of FIG. 14) the user may turn on child unit 300 and parent unit 200, via switches 29 and 39, respectively. Activating the power switch 39 on the child unit 300 not only enables the unit to be turned on, it may also cause an audible and/or visual and/or tactile message (e.g., "Ready to go? Do you have your helmet on? If you do, push the helmet button.", with other accompanying sounds, such as a revving car engine or other entertaining sound) to be provided to the child (step 2002). At this point, if the child does not have their helmet on, they have been encouraged to put their helmet on without being nagged by their guardian. Once they have their helmet on, they push the helmet on button 390*f* (Step 2004) and the child unit 200 provides a celebratory visual and/or audible and/or tactile response 350 praising the child (Step 2005). At this point, the child is ready to begin riding their bike or other mobile apparatus. If the child does not indicate that they put their helmet on (Step 2003), after a set amount of time Step 2002 is repeated as needed until Step 2004 is completed. After an excessive amount of time without a response the units may turn themselves off or go into a sleep mode to conserve power.

At Step 2006, when the child has indicated that they have their helmet on and is ready to begin biking, if the signal strength level between the child unit and the parent unit is within the "go" predetermined signal strength level, the parent unit 200 automatically transmits a signal that is received by antenna 28 on the child unit 300, activating a visual and audio output via the output indicating device 42 (e.g., visual output indicator (390*c*) or an audible or tactile indicator) on the child unit 300 (step 2009), at this point the child may get excited and begin biking.

If at step 2006, the signal strength between the parent unit and the child unit 300 reaches another predetermined signal strength level reflective of step 2007*a* (e.g. a first predetermined level, stop level) or reflective of step 2007*b* (e.g. a second predetermined level, caution level, step 2007*b*), the appropriate indicator on child unit 300 provides a response to the user of the child unit.

Step 2007 continues until the signal strength drops to the "go" range" or the signal strength detection level is such that another predetermined signal strength level is reached. Step 2007 is not limited to steps 2007*a* and 2007*b*, any number of different levels of signal strength level based protective messages may be provided to the user of the child unit 300 as desired or deemed necessary. Signal strength levels reflective of "safe situations" may provide other non-protective messages as well (e.g., to communicate go, keep going, great job). This signal strength check may be ongoing, either continuously or intermittently.

Continuing on, in an embodiment including not only the auto mode, but also includes directional actuators on the parent unit 200 via actuators 290*d, e* or *g*, the following steps 2010-2011 may be included. For example, if the parent wants the child to move over to the right side of the trail because of on-coming traffic or to teach them proper biking manners, they can actuate switch 290*e* which will create a visual and/or audio and/or tactile output via the output indicating device 42, if visual, through indicator 390*e* on child unit 300 telling the child to move to the right. This direction providing feature is much improved compared to a parent yelling to the child to move to the right because often younger children can't remember their left from their right. Output indicator 390*e* is in the shape of an arrow pointing to the right, helping them to learn their right from their left. The entire display/output indicating device 42 can be made educational in content to teach kids their colors, shapes, directions and so forth. The output indicators 42 are made in various shapes as shown in FIG. 2*a*, and the audible message corresponding to each indicator can name the color of the indicator or say what shape, or some other fact in order to make learning fun.

At Step 2012, when the child is done using the device, upon turning off child unit 300, the child unit 300 may provide another celebratory response and reminder such as "make sure to put your things away, great job today, didn't we have fun?" message.

The various features of the new and unique invention have been described in relation to providing audio, visual and/or tactile indication to a child riding a bike. However, the indicating system described could be used to communicate to a person of any age, on any type of mobile apparatus, or on foot. Moreover, other embodiments, variations and modifications exist that would not depart from the scope of the invention. A number of these variations have been set forth above, however, additional variations can be contemplated, especially with regard to the means for attaching the device or incorporating the features into the design of a mobile apparatus such as a bike without a central housing, the types of indicators and means for indication, and the types of road rules or commands to be indicated can be contemplated by those skilled in the art without extending from the scope of this invention.

What is claimed is:

1. An indicating system for providing instructions remotely from a parent unit to a user of one or more child units comprising;

a parent unit comprising:
- a parent unit housing;
- a parent unit power source associated with the parent unit housing;
- a parent communication unit operably connected to the parent unit power source;
- a first actuator element;

one or more remotely located child units comprising:
- a child unit housing;
- a child unit power source associated with the child unit housing;
- a child communication unit operably connected to the child unit power source, the child communication unit operable to receive one or more signals from the parent communication unit; and an output indicating device;

wherein when the first actuator element on the parent unit is actuated, an instruction comprising an indication that the user of the child unit can go is generated on the output indicating device of the child unit;

wherein when a strength of the signal between the parent unit and the child unit drops below a predetermined level or a measured distance between the parent unit and the child unit exceeds a first distance threshold, a pre-recorded protective instruction comprising an indication that the user of the child unit should stop is automatically generated by the output indicating device of the child unit based on the strength of the signal dropping below the predetermined level or the measured distance exceeding the first distance threshold.

2. The indicating system of claim 1, wherein when the strength of the signal between the parent unit and the child unit drops below a second predetermined level or the measured distance between the parent unit and the child unit exceeds a second distance threshold, a second pre-recorded instruction is automatically generated by the output indicating device of the child unit, wherein the second predetermined level is higher than the first predetermined level, or the second distance threshold is shorter than the first distance threshold.

3. An indication system for remotely providing instructions from a guardian to another user comprising;

a parent unit comprising:

a parent unit housing;

a parent unit power source associated with the parent unit housing;

a parent communication unit operably connected to the parent unit power source configured to transmit signals communicating one or more traffic signal based instructions;

one or more remotely located child units comprising:

a child unit housing;

a child unit power source associated with the child unit housing;

a child communication unit operably connected to the child unit power source, the child communication unit operable to receive a signal from the parent communication unit; and an output indicating device;

wherein the output indicating device comprises one or more instructional indicators configured to communicate one or more traffic signal based instructions, wherein the traffic signal based instructions indicate the direction, movement and/or non-movement, relative to the user, that the guardian wants the user of the remotely located child unit to undertake;

wherein when a strength of the signal between the parent unit and the child unit drops below a predetermined level or a measured distance between the parent unit and the child unit exceeds a first distance threshold, a protective instruction is generated by the output indicating device of the child unit wherein when a strength of the signal between the parent unit and the child unit drops below a second predetermined level or exceeds a second distance threshold, a second protective instruction comprising an indication that the user should slow down, use caution, or prepare to stop is generated by the output indicating device of the child unit.

4. The indication system of claim 3, wherein the protective instruction comprises an indication configured to communicate that the user should stop or wait.

5. The indication system of claim 3, wherein the child unit includes a power switch, wherein turning on or off the power switch prompts the user to take a specific action or to actuate one or more actuators located on the child unit.

6. The indication system of claim 3, further comprising one or more actuators on the child unit, wherein actuation of at least one of the one or more actuators on the child unit results in a visual, audio or tactile celebratory response via the output indicating device.

7. The indication system of claim 3, wherein the child unit includes a power switch and a speaker, wherein when the power switch is switched into the on position, the output indicating device is configured to automatically communicate a pre-recorded message via the speaker, wherein the pre-recorded message comprises an inquiry as to whether the user is wearing a helmet, or suggests the user puts on a helmet.

8. The indicating system of claim 1, wherein the child unit includes a power switch, wherein turning on or off the power switch prompts the user to take a specific action or to actuate one or more actuators located on the child unit.

9. The indicating system of claim 1, further comprising one or more actuators on the child unit, wherein actuation of at least one of the one or more actuators on the child unit results in a visual, audio or tactile celebratory response via the output indicating device.

10. The indicating system of claim 1, wherein the child unit includes a power switch and a speaker, wherein the power switch is configured to play a pre-recorded message via the speaker when switched into the on position, wherein the pre-recorded message comprises an inquiry as to whether the user is wearing a helmet, or suggests the user puts on a helmet.

11. The indicating system of claim 1, wherein the parent unit comprises one or more traffic signal based actuation elements that transmit signals upon actuation, and wherein the child unit comprises one or more traffic signal based indicators, wherein the one or more traffic signal based indicators on the child unit produces a response upon receiving one or more signals from the parent unit, further wherein at least one of the one or more traffic signal based indicators on the child unit is configured to communicate that the user should not move, should prepare to stop, move to the right, move to the left, turn around, or make a u-turn.

12. The indication system of claim 3, wherein the parent unit comprises a first actuator element, wherein when the first actuator element on the parent unit is actuated, an instruction comprising an indication that the user of the child unit can go is generated on the output indicating device of the child unit.

13. An indicating system for providing instructions remotely from a parent unit to a user of one or more child units comprising;

a parent unit comprising:

a parent unit housing;

a parent unit power source associated with the parent unit housing;

a parent communication unit operably connected to the parent unit power source;

one or more remotely located child units comprising:

a child unit housing;

a child unit power source associated with the child unit housing;

a power switch operably connected to the power source;

a child communication unit operably connected to the child unit power source, the child communication unit operable to receive one or more signals from the parent communication unit; and an output indicating device;

wherein when a strength of the signal between the parent unit and the child unit drops below a predetermined level or a measured distance between the parent unit and the child unit and the child unit exceeds a distance threshold, a protective instruction comprising an indication that the user of the child unit should stop is automatically generated by the output indicating device of the child unit based on the strength of the signal dropping below the predetermined level or exceeding the distance threshold;

wherein turning on or off the power switch prompts the user to take a specific action or to actuate one or more actuators located on the child unit.

14. The indicating system of claim 13, wherein actuation of the one or more actuators on the child unit results in a visual, audio or tactile celebratory response via the output indicating device.

15. The indicating system of claim 13, wherein the child unit includes a speaker, wherein the power switch is configured to play a pre-recorded message via the speaker when switched into the on position, wherein the pre-recorded message comprises an inquiry as to whether the user is wearing a helmet, or suggests the user puts on a helmet.

16. The indicating system of claim 13, wherein the parent unit comprises a first actuator element, wherein when the first actuator element on the parent unit is actuated, an instruction comprising an indication that the user of the child unit can go is generated on the output indicating device of the child unit.

17. The indicating system of claim 2, wherein the second pre-recorded instruction comprises a indication that the user should slow down, use caution, or prepare to stop.

18. The indicating system of claim 13, The wherein the parent unit comprises one or more traffic signal based actuation elements that transmit signals upon actuation, and wherein the child unit comprises one or more traffic signal based indicators, wherein the one or more traffic signal based indicators on the child unit produces a response upon receiving one or more signals from the parent unit, further wherein at least one of the one or more traffic signal based indicators on the child unit is configured to communicate that the user should go, should not move, prepare to stop, move to the right, move to the left, turn around, or make a u-turn.

19. The indicating system of claim 13, wherein when the strength of the signal between the parent unit and the child unit drops below a second predetermined level or the measured distance between the parent unit and the child unit exceeds a second distance threshold, a second pre-recorded instruction is automatically generated by the output indicating device of the child unit.

* * * * *